US010357706B2

(12) United States Patent
Snow et al.

(10) Patent No.: US 10,357,706 B2
(45) Date of Patent: Jul. 23, 2019

(54) FOUR-CARD POKER WITH VARIABLE WAGER OVER A NETWORK

(71) Applicant: Bally Gaming, Inc., Las Vegas, NV (US)

(72) Inventors: Roger M. Snow, Las Vegas, NV (US); Louis J. Castle, II, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/898,552

(22) Filed: Feb. 17, 2018

(65) Prior Publication Data

US 2018/0169507 A1 Jun. 21, 2018

Related U.S. Application Data

(63) Continuation of application No. 14/034,295, filed on Sep. 23, 2013, now abandoned, which is a (Continued)

(51) Int. Cl.
*A63F 1/00* (2006.01)
*G07F 17/32* (2006.01)

(52) U.S. Cl.
CPC ..... *A63F 1/00* (2013.01); *G07F 17/3293* (2013.01)

(58) Field of Classification Search
CPC ..... G07F 17/3293; A63F 2001/001; A63F 2001/003; A63F 2001/005; A63F 2001/006; A63F 2001/008
(Continued)

(56) References Cited

U.S. PATENT DOCUMENTS 1,238,736 A 9/1917 Barrett
1,527,929 A 2/1925 Simons
(Continued)

FOREIGN PATENT DOCUMENTS

AU 200135060 A1 10/2001
CA 2529076 A1 6/2006
(Continued)

OTHER PUBLICATIONS

"The Silicon Gaming Odyssey Slot Machine" (Levinthal, et al., 1063-6390/97, 1997, IEEE Xplore database).*
(Continued)

*Primary Examiner* — David L Lewis
*Assistant Examiner* — Matthew D Hoel
(74) *Attorney, Agent, or Firm* — TraskBritt

(57) ABSTRACT

An online casino game utilizes at least one deck of playing cards. Each player places an initial wager. A first and a second number of cards are dealt to a dealer and to each player, respectively. The first and the second numbers are greater than the number of cards to be used in determining a poker rank hand for the dealer and for each player, respectively. The dealer and each player discard at least one card to form a dealer hand and a player hand, respectively, having an equal number of cards. Each player hand is resolved against the dealer hand according to predetermined game rules. The initial wager must be at least matched with a game wager (play wager), which may be a multiple of the initial wager (e.g., 1× to 5×, at the option of the player), for the player to remain in the game after receiving his cards.

19 Claims, 10 Drawing Sheets

Related U.S. Application Data continuation-in-part of application No. 13/631,821, filed on Sep. 28, 2012, now abandoned, which is a continuation-in-part of application No. 11/499,864, filed on Aug. 4, 2006, now abandoned, which is a continuation of application No. 10/152,325, filed on May 20, 2002, now abandoned.

(58) Field of Classification Search
USPC ..... 463/11–13; 272/292
See application file for complete search history.

(56) References Cited

U.S. PATENT DOCUMENTS 1,763,476 A 6/1930 Morris
1,970,876 A 8/1934 Anderson
2,008,829 A 7/1935 Israel
2,199,745 A 5/1940 Harris
3,011,789 A 12/1961 Eliassen et al.
3,269,503 A 8/1966 Foster
3,556,531 A 1/1971 Elder
3,663,021 A 5/1972 Whippo
3,667,757 A 6/1972 Holmberg
3,689,071 A 9/1972 Kucera
3,796,433 A 3/1974 Fraley et al.
3,825,255 A 7/1974 Kennard et al.
3,876,208 A 4/1975 Wachtler et al.
4,063,680 A 12/1977 Leo
4,099,722 A 7/1978 Rodesch et al.
4,232,866 A 11/1980 Pennachio
4,302,012 A 11/1981 Di Giovanni et al.
4,305,586 A 12/1981 Richards
4,364,567 A 12/1982 Gootl
4,397,469 A 8/1983 Carter, III
4,518,001 A 5/1985 Branham
4,531,187 A 7/1985 Uhland
4,575,085 A 3/1986 Olington
4,614,342 A 9/1986 Takashima
4,624,459 A 11/1986 Kaufman
4,648,604 A 3/1987 Horan
4,651,997 A 3/1987 Wood
4,700,948 A 10/1987 Okada
4,721,307 A 1/1988 Okada
4,743,022 A 5/1988 Wood
4,756,531 A 7/1988 DiRe et al.
4,759,549 A 7/1988 Beckwith
4,760,527 A 7/1988 Sidley
4,813,675 A 3/1989 Greenwood
4,836,546 A 6/1989 DiRe et al.
4,836,553 A 6/1989 Suttle et al.
4,837,728 A 6/1989 Barrie et al.
4,861,041 A 8/1989 Jones et al.
4,948,134 A 8/1990 Suttle et al.
4,964,638 A 10/1990 Ishida
5,022,653 A 6/1991 Suttle et al.
5,046,736 A 9/1991 Bridgeman et al.
5,078,405 A 1/1992 Jones et al.
5,098,107 A 3/1992 Boylan et al.
5,100,137 A 3/1992 Fulton
5,112,060 A 5/1992 Jones
5,167,413 A 12/1992 Fulton
5,174,579 A 12/1992 Griffiths
5,221,083 A 6/1993 Dote
5,242,163 A 9/1993 Fulton
5,251,897 A 10/1993 Fulton
5,255,915 A 10/1993 Miller
5,257,784 A 11/1993 Boylan et al.
5,257,810 A 11/1993 Schorr et al.
5,265,877 A 11/1993 Boylan et al.
5,275,415 A 1/1994 Wisted
5,288,077 A 2/1994 Jones
5,288,081 A 2/1994 Breeding
5,294,128 A 3/1994 Marquez
5,308,065 A 5/1994 Bridgeman et al.
5,322,295 A 6/1994 Cabot et al.
5,324,035 A 6/1994 Morris et al.
5,364,104 A 11/1994 Jones et al.
5,366,228 A 11/1994 Kangsanaraks
5,377,973 A 1/1995 Jones et al.
5,377,993 A 1/1995 Josephs
5,377,994 A 1/1995 Jones
5,380,012 A 1/1995 Jones et al.
5,395,120 A 3/1995 Malek
5,397,128 A 3/1995 Hesse et al.
5,411,257 A 5/1995 Fulton
5,413,353 A 5/1995 Demarest et al.
5,417,430 A 5/1995 Breeding
5,423,551 A 6/1995 Stavinsky
5,431,408 A 7/1995 Adams
5,437,451 A 8/1995 Fulton
5,489,101 A 2/1996 Moody
5,494,295 A 2/1996 Potter et al.
5,505,449 A 4/1996 Eberhardt et al.
5,531,448 A 7/1996 Moody
5,538,252 A 7/1996 Green
5,584,486 A 12/1996 Franklin
5,597,162 A 1/1997 Franklin
5,603,502 A 2/1997 Nagagawa
5,630,757 A 5/1997 Gagin et al.
5,636,842 A 6/1997 Cabot et al.
5,645,281 A 7/1997 Hesse et al.
5,649,705 A * 7/1997 String ..... A63F 3/00157 273/274
5,653,444 A * 8/1997 Dahl ..... A63F 3/00157 273/274
5,657,993 A 8/1997 Merlino et al.
5,660,393 A 8/1997 Dreger
5,669,817 A 9/1997 Tarantino
5,673,917 A 10/1997 Vancura
5,678,821 A 10/1997 Hedman
5,685,774 A 11/1997 Webb
5,697,614 A 12/1997 Potter et al.
5,707,286 A 1/1998 Carlson
5,711,525 A 1/1998 Breeding
5,718,430 A 2/1998 Arampakul et al.
5,725,216 A * 3/1998 Jones ..... A63F 1/00 273/292
5,732,950 A 3/1998 Moody
5,741,183 A 4/1998 Acres et al.
5,752,702 A 5/1998 McDoniel
5,762,340 A 6/1998 Feola
RE35,864 E 7/1998 Weingardt
5,800,268 A 9/1998 Molnick et al.
5,806,855 A * 9/1998 Cherry ..... A63F 3/00157 273/292
5,810,354 A 9/1998 Banyai
5,810,663 A 9/1998 Bochichio et al.
5,820,460 A 10/1998 Fulton
5,823,873 A 10/1998 Moody
5,830,069 A 11/1998 Soltes et al.
5,839,732 A 11/1998 Guidi
5,845,906 A 12/1998 Wirth
5,851,011 A * 12/1998 Lott ..... A63F 3/00157 273/292
5,851,149 A 12/1998 Xidos et al.
5,865,437 A 2/1999 Moore, Jr.
5,871,213 A 2/1999 Chadband et al.
5,876,283 A 3/1999 Parra et al.
5,897,436 A 4/1999 Singer et al.
5,901,958 A 5/1999 Andrews
5,928,081 A 7/1999 Bochichio et al.
5,934,998 A 8/1999 Forte et al.
5,944,315 A 8/1999 Mostashari
5,975,529 A 11/1999 de Keller
5,984,310 A 11/1999 English
5,988,643 A 11/1999 Awada
5,997,002 A 12/1999 Goldman
5,999,808 A 12/1999 LaDue
6,012,719 A 1/2000 Webb
6,019,374 A 2/2000 Breeding
6,027,119 A 2/2000 De Lisle
6,042,118 A 3/2000 Poitra
6,056,641 A 5/2000 Webb
6,070,873 A 6/2000 Perkins

(56) References Cited

U.S. PATENT DOCUMENTS 6,098,984 A 8/2000 Moore, Jr.
6,098,985 A 8/2000 Moody
6,102,400 A 8/2000 Scott et al.
6,102,402 A * 8/2000 Scott ..... A63F 3/00157 273/274
6,113,101 A 9/2000 Wirth
6,113,103 A 9/2000 Mostashari
6,142,872 A 11/2000 Walker et al.
6,149,154 A 11/2000 Grauzer et al.
6,170,827 B1 * 1/2001 Lombardo ..... A63F 3/00157 273/274
6,196,918 B1 3/2001 Miers et al.
6,206,373 B1 3/2001 Garrod
6,206,374 B1 * 3/2001 Jones ..... A63F 1/00 273/292
6,206,780 B1 3/2001 Awada
6,210,274 B1 4/2001 Carlson
6,229,534 B1 5/2001 Gerra et al.
6,237,916 B1 * 5/2001 Webb ..... A63F 3/00157 273/292
6,270,078 B1 8/2001 Leone et al.
6,270,079 B1 8/2001 Chamberlain
6,272,223 B1 8/2001 Carlson
6,273,424 B1 8/2001 Breeding
6,279,910 B1 8/2001 de Keller
6,299,171 B1 10/2001 Mollo et al.
6,299,534 B1 10/2001 Breeding et al.
D452,283 S 12/2001 Regan, II et al.
6,325,375 B1 12/2001 Potter et al.
6,332,614 B1 * 12/2001 Hesse ..... A63F 1/00 273/274
6,334,614 B1 1/2002 Breeding
6,336,859 B2 1/2002 Jones et al.
6,345,823 B1 * 2/2002 Webb ..... A63F 3/00157 273/292
6,375,189 B1 4/2002 Jones
6,406,024 B1 6/2002 Perkins
6,409,602 B1 6/2002 Wiltshire et al.
6,428,005 B2 8/2002 Au-Yeung
6,467,771 B1 10/2002 deKeller
6,478,675 B1 11/2002 Awada
6,485,368 B2 11/2002 Jones et al.
6,517,072 B1 2/2003 McInerney
6,517,074 B1 2/2003 Moody et al.
6,533,658 B1 3/2003 Walker et al.
6,561,897 B1 5/2003 Bourbour et al.
6,568,680 B1 5/2003 Moody et al.
6,581,936 B1 6/2003 Zoccolillo et al.
6,585,588 B2 7/2003 Hartl
6,588,750 B1 7/2003 Grauzer et al.
6,607,443 B1 8/2003 Miyamoto et al.
6,637,747 B1 10/2003 Garrod
6,644,666 B1 11/2003 Tamura et al.
6,651,981 B2 11/2003 Grauzer et al.
6,651,982 B2 11/2003 Grauzer et al.
6,652,377 B1 11/2003 Moody
6,655,684 B2 12/2003 Grauzer et al.
6,695,699 B2 * 2/2004 Beaulieu ..... G07F 17/32 463/12
6,698,759 B2 3/2004 Webb et al.
6,705,943 B2 3/2004 Awada
6,712,702 B2 3/2004 Goldberg et al.
6,719,291 B1 4/2004 deKeller
6,726,564 B2 4/2004 Hogan et al.
6,749,200 B2 6/2004 Yurkins
6,749,510 B2 6/2004 Giobbi
6,752,394 B2 6/2004 Malcolm
6,755,741 B1 6/2004 Rafaeli
6,758,751 B2 7/2004 Soltys et al.
6,802,773 B2 10/2004 Moody
6,811,153 B1 11/2004 Ko
6,827,348 B1 12/2004 Mitchell
6,869,076 B1 3/2005 Moore et al.
6,896,265 B1 5/2005 Schlumbrecht
6,899,628 B2 5/2005 Leen et al.
6,923,446 B2 8/2005 Snow
6,929,264 B2 8/2005 Huard et al.
6,955,356 B2 10/2005 Moody
6,959,928 B2 11/2005 Schultz
6,964,418 B2 11/2005 Moody
6,976,589 B2 12/2005 De Raedt et al.
6,986,514 B2 1/2006 Snow
D518,112 S 3/2006 Abbott et al.
7,011,309 B2 3/2006 Soltys et al.
D519,164 S 4/2006 Austin
7,029,011 B2 4/2006 Strong et al.
7,056,215 B1 6/2006 Olive
7,108,603 B2 9/2006 Olive
7,128,650 B2 * 10/2006 Saffari ..... G06Q 30/0207 463/25
7,128,652 B1 10/2006 Lavoie et al.
7,140,964 B2 11/2006 Walker et al.
7,175,522 B2 2/2007 Hartl
7,186,181 B2 3/2007 Rowe
7,189,161 B1 3/2007 Wiltshire et al.
7,203,841 B2 4/2007 Jackson et al.
7,246,799 B2 7/2007 Snow
7,247,092 B2 * 7/2007 Jarvis ..... G07F 17/32 273/292
D548,799 S 8/2007 Looney et al.
7,261,298 B1 8/2007 Schlumbrecht
7,264,243 B2 9/2007 Yoseloff et al.
7,297,062 B2 11/2007 Gatto et al.
7,303,473 B2 12/2007 Rowe
7,331,580 B2 2/2008 Scibetta
7,338,361 B1 * 3/2008 Luciano, Jr. ..... G07F 17/32 463/12
7,387,300 B2 * 6/2008 Snow ..... A63F 3/00157 273/274
7,438,295 B2 10/2008 Aida
7,510,191 B1 3/2009 Schlumbrecht
7,510,193 B1 3/2009 Schlumbrecht
7,510,478 B2 3/2009 Benbrahim et al.
7,515,718 B2 4/2009 Nguyen et al.
7,516,959 B2 4/2009 Huard et al.
7,537,456 B2 5/2009 Snow
7,584,967 B2 * 9/2009 Webb ..... A63F 3/00157 273/292
7,584,968 B2 9/2009 Campbell et al.
7,611,404 B1 11/2009 Hilf et al.
7,628,689 B2 12/2009 Snow
7,632,184 B2 12/2009 Gauselmann
7,846,018 B2 1/2010 Baerlocher
7,661,676 B2 2/2010 Smith et al.
7,666,095 B2 2/2010 Van Luchene
7,722,048 B2 5/2010 Smith et al.
7,744,452 B2 6/2010 Cimring et al.
7,780,529 B2 8/2010 Rowe et al.
7,794,319 B2 9/2010 Luciano, Jr. et al.
7,824,255 B2 11/2010 Lutnick et al.
7,867,091 B2 1/2011 Moshal
7,871,323 B2 1/2011 Walker et al.
7,874,901 B2 1/2011 Kirkpatrick
7,905,770 B2 3/2011 Snow
7,909,689 B2 3/2011 Lardie
7,931,533 B2 4/2011 LeMay et al.
7,946,911 B2 5/2011 Vang et al.
7,988,554 B2 8/2011 LeMay et al.
8,062,134 B2 11/2011 Kelly et al.
8,070,574 B2 12/2011 Grauzer et al.
8,092,289 B2 1/2012 Mai
8,092,307 B2 1/2012 Kelly
8,092,309 B2 1/2012 Bickley
8,172,661 B1 5/2012 Hein
8,590,900 B2 11/2013 Yoseloff
8,672,735 B2 3/2014 Mills
9,126,102 B2 9/2015 Snow et al.
2001/0040345 A1 11/2001 Au-Yeung
2001/0048197 A1 12/2001 Lo
2002/0008356 A1 1/2002 De Keller
2002/0049909 A1 4/2002 Jackson et al.
2002/0103018 A1 8/2002 Rommerdahl et al.
2002/0113371 A1 8/2002 Snow

(56) References Cited

U.S. PATENT DOCUMENTS

2002/0175468 A1* 11/2002 Kenny ..... A63F 3/00157 273/274
2002/0190469 A1 12/2002 Conklin et al.
2002/0195775 A1* 12/2002 Webb ..... A63F 3/00157 273/292
2003/0042679 A1 3/2003 Snow
2003/0050106 A1 3/2003 Lyfuong
2003/0064769 A1* 4/2003 Muir ..... G07F 17/32 463/16
2003/0176209 A1 9/2003 Soltys et al.
2003/0199316 A1 10/2003 Miyamoto et al.
2004/0023712 A1 2/2004 Oliver
2004/0036217 A1 2/2004 Schlumbrecht
2004/0100025 A1 5/2004 Conklin et al.
2004/0102234 A1 5/2004 Gold
2004/0150163 A1 8/2004 Kenny et al.
2004/0160006 A1 8/2004 Kenny et al.
2004/0178582 A1 9/2004 Garrod
2004/0180722 A1 9/2004 Giobbi
2004/0204231 A1 10/2004 Martin et al.
2004/0217548 A1 11/2004 Snow
2004/0224777 A1 11/2004 Smith et al.
2005/0029741 A1 2/2005 Snow et al.
2005/0032563 A1 2/2005 Sines
2005/0032564 A1 2/2005 Sines
2005/0051958 A1 3/2005 Snow
2005/0051962 A1 3/2005 Chapman
2005/0104292 A1 5/2005 Schultz
2005/0107148 A1 5/2005 Webb
2005/0143166 A1 6/2005 Walker et al.
2005/0146093 A1 7/2005 Grauzer et al.
2005/0148383 A1 7/2005 Mayeroff
2005/0164759 A1 7/2005 Smith et al.
2005/0164762 A1 7/2005 Smith et al.
2005/0192092 A1 9/2005 Breckner et al.
2005/0218596 A1 10/2005 Adam et al.
2005/0242506 A1 11/2005 Yoseloff
2005/0269782 A1 12/2005 Sklansky et al.
2006/0040745 A1 2/2006 Wells et al.
2006/0058087 A1 3/2006 White et al.
2006/0068899 A1 3/2006 White et al.
2006/0084506 A1 4/2006 Yoseloff et al.
2006/0087082 A1 4/2006 Ko
2006/0108736 A1 5/2006 Walker et al.
2006/0108740 A1 5/2006 Kekempanos et al.
2006/0119044 A1 6/2006 Kekempanos et al.
2006/0135238 A1* 6/2006 Lancaster ..... G07F 17/32 463/12
2006/0145417 A1 7/2006 Grauzer et al.
2006/0178183 A1 8/2006 Van Asdale
2006/0186599 A1 8/2006 Kenny et al.
2006/0189381 A1 8/2006 Daniel et al.
2006/0205508 A1 9/2006 Green
2006/0267285 A1* 11/2006 Webb ..... A63F 3/00157 273/292
2006/0270477 A1 11/2006 Snow
2006/0281513 A1 12/2006 Kirkpatrick
2006/0281534 A1 12/2006 Grauzer et al.
2006/0284376 A1 12/2006 Snow
2006/0287103 A1 12/2006 Crawford, III et al.
2007/0024005 A1* 2/2007 Snow ..... A63F 3/00157 273/292
2007/0026935 A1 2/2007 Wolf et al.
2007/0055753 A1 3/2007 Robb
2007/0057462 A1 3/2007 Fleckenstein
2007/0057469 A1 3/2007 Grauzer et al.
2007/0069462 A1 3/2007 Downs, III et al.
2007/0072677 A1 3/2007 Lavoie et al.
2007/0075494 A1 4/2007 Abbott
2007/0102882 A1 5/2007 Snow
2007/0111786 A1 5/2007 Snow
2007/0184905 A1 8/2007 Gatto et al.
2007/0197294 A1 8/2007 Gong
2007/0197298 A1 8/2007 Rowe
2007/0202941 A1 8/2007 Miltenberger et al.
2007/0205559 A1* 9/2007 Webb ..... G07F 17/32 273/292
2007/0210520 A1* 9/2007 Webb ..... A63F 3/00157 273/292
2007/0213116 A1 9/2007 Crawford et al.
2007/0214058 A1 9/2007 Rouhi et al.
2007/0225061 A1 9/2007 Naobayashi
2007/0298854 A1 12/2007 Yoseloff et al.
2008/0026807 A1 1/2008 Moshal et al.
2008/0032763 A1 2/2008 Giobbi
2008/0039192 A1 2/2008 Laut
2008/0039208 A1 2/2008 Abrink et al.
2008/0042355 A1 2/2008 Snow
2008/0054568 A1 3/2008 Lutnick et al.
2008/0073840 A1 3/2008 Comeau
2008/0096656 A1 4/2008 LeMay et al.
2008/0108412 A1 5/2008 Snow et al.
2008/0136102 A1 6/2008 Hoover
2008/0176627 A1 7/2008 Lardie
2008/0179830 A1* 7/2008 Webb ..... A63F 3/00157 273/274
2008/0248875 A1 10/2008 Beatty
2008/0252011 A1 10/2008 Bickley et al.
2009/0100409 A1 4/2009 Toneguzzo
2009/0121434 A1 5/2009 Baerlocher et al.
2009/0121437 A1 5/2009 Snow et al.
2009/0124385 A1 5/2009 Cuddy et al.
2009/0156310 A1 6/2009 Fargo
2009/0176547 A1 7/2009 Katz
2009/0298577 A1 12/2009 Gagner et al.
2009/0302540 A1* 12/2009 Snow ..... G07F 17/32 273/292
2009/0315264 A1 12/2009 Snow et al.
2010/0016050 A1 1/2010 Snow et al.
2010/0048304 A1 2/2010 Boesen
2010/0069155 A1 3/2010 Schwartz et al.
2010/0178987 A1 7/2010 Pacey
2010/0197410 A1 8/2010 Leen et al.
2010/0234110 A1 9/2010 Clarkson
2010/0240440 A1 9/2010 Szrek et al.
2010/0255899 A1 10/2010 Paulsen
2011/0074107 A1 3/2011 Rowe
2011/0105208 A1 5/2011 Bickley
2011/0130184 A1 6/2011 Mills
2011/0130190 A1 6/2011 Hamman et al.
2011/0159952 A1 6/2011 Kerr
2011/0159953 A1 6/2011 Kerr
2011/0165936 A1 7/2011 Kerr
2011/0172008 A1 7/2011 Alderucci
2011/0183748 A1 7/2011 Wilson et al.
2011/0230268 A1 9/2011 Williams
2011/0263320 A1 10/2011 Tara
2011/0269529 A1 11/2011 Baerlocher
2011/0275430 A1 11/2011 Walker et al.
2011/0287829 A1 11/2011 Clarkson et al.
2012/0015724 A1 1/2012 Ocko et al.
2012/0015725 A1 1/2012 Ocko et al.
2012/0015743 A1 1/2012 Lam et al.
2012/0015747 A1 1/2012 Ocko et al.
2012/0021835 A1 1/2012 Keller et al.
2012/0034977 A1 2/2012 Kammler
2012/0295691 A1 11/2012 Walker
2013/0023319 A1 1/2013 Snow
2013/0023335 A1 1/2013 Snow
2013/0029738 A1 1/2013 Snow
2013/0053117 A1 2/2013 Snow
2013/0184059 A1 7/2013 Costello et al.
2013/0184060 A1 7/2013 Costello et al.
2013/0184079 A1 7/2013 Costello et al.
2013/0274003 A1 10/2013 Costello
2013/0296024 A1 11/2013 Castle, II
2013/0296025 A1 11/2013 Castle, II et al.
2015/0379825 A1 12/2015 Snow et al.

(56) References Cited

U.S. PATENT DOCUMENTS

FOREIGN PATENT DOCUMENTS

| | | | |
|---|---|---|---|
| DE | 2830216 | A1 | 1/1980 |
| DE | 3003376 | A1 | 8/1981 |
| EP | 338644 | A2 | 10/1989 |
| GB | 667345 | A | 2/1952 |
| GB | 2097570 | A1 | 11/1982 |
| GB | 2184029 | A | 6/1987 |
| GB | 9414822 | | 7/1994 |
| GB | 9426324 | | 12/1994 |
| WO | 2007047223 | A2 | 4/2007 |
| WO | 2008061001 | A2 | 5/2008 |
| WO | 2009061618 | A1 | 5/2009 |
| WO | 2011109454 | A1 | 9/2011 |

OTHER PUBLICATIONS

"Bad Beat Texas Hold Em" (Rack Card), Shuffle Master, Inc., 2005.
"Card Craps," Scame's Encyclopedia of Card Games, pp. 321-323, 1948.
R. Gros, "Working Within the Systems: IGT's Linked Progressive Programs Take Leap to the Tables," Casino Journal, vol. 8, No. 12, Dec. 1992, pp. 10-11, 13, 15, 40-41.
Copyright filing with the Bureau voor de Intellectuele Eigendom, Aruba, 13 pgs (Jan. 13, 1998).
"Flop-A-Lock," Flop-A-Lock, Inc., 2006, (1 page).
"Texas Shootout," Galaxy Gaming, Inc., http://www.galaxygaming.com/texasshootout.htm, visited Mar. 7, 2006, (5 pages).
Walter B. Gibson, "Hoyle's Modern Encyclopedia of Card Games," 1974, pp. 252, 257, 258.
Hoyle's Modern Encyclopedia of Card Games by Walter Gibson, p. 250, 3 pages.
Information Disclosure Statement (describing "Sklansky's Casino Poker" and "Video Poker"), Apr. 7, 1988.
"WPT World Power Tour, All-In Hold'em," Lakes Entertainment Inc., http://lakesentertainment.com/games/wpt/, visited Mar. 7, 2006, (6 pages).
Levinthal, et al., "The Silicon Gaming Odyssey Slot Machine," IEEE Xplore database, 1063-6390/97, Silicon Gaming, Inc., (1997), pp. 296-301.
John Marchel, "Kiss Guide to Gambling," DK Publishing Inc., Glossary, "No-Limit," 2001, p. 344.
"Mikohn Launches Texas Hold 'Em Bonus Poker Table Game," Business Wire, http://www.findarticles.com/p/articles/mi_m0EIN/is_2004_July_26/ai_n6122536/print, Jul. 26, 2004.
30 N.J.R. 2639(b), "Rule Adoption, Other Agencies, Casino Control Commission, Accounting and Controls, Gaming Equipment, Rules of the Games, Fast Action Hold'Em," New Jersey Register, vol. 30, No. 14, Jul. 20, 1998, (14 pages).
United States Office Action, U.S. Appl. No. 13/624,743, dated Jan. 29, 2013, 7 pages.
United States Office Action, U.S. Appl. No. 13/631,818, dated Oct. 29, 2013, 8 pages.
United States Office Action, U.S. Appl. No. 13/631,821, dated Oct. 29, 2013, 7 pages.
United States Office Action, U.S. Appl. No. 13/631,821, dated Apr. 3, 2014, 7 pages.
"Poker Rules & Poker Questions Answered" ("Texas Hold'em," "Omaha High," "Deuces Wild Poker," "Caribbean Poker," "Poker Rules," "How to play poker, how to play Texas Hold'em Poker,"), htt://www.oldvegaschips.com, visited Mar. 10, 2006, (42 pages).
"Over/Under 13TM Blackjack" (Brochure), Gaming Concepts, Inc., 1988.
International Search Report of the International Searching Authority for PCT/US13/22153, dated Apr. 8, 2013, 2 pages.
International Search Report of the International Searching Authority for PCT/US2013/038688, dated Oct. 10, 2013, 4 pages.
International Search Report and Written Opinion of the International Searching Authority for PCT/US2013/021959, dated May 10, 2013, 7 pages.
"Table Games—Texas Hold'Em Bonus Poker," Progressive Gaming International Corporation, http://www.virtgame.com/pages/games/texasholdem.html, visited Mar. 7, 2006, (2 pages).
Published Rule Sheet for Casino Poker from Vegas World, 1 page (1982).
"Live Casino Gaming" ("Deuces Wild Hold'em Fold'em"), Riverside Resort, http://www.riversideresort.com/Gaming/live-games.htm, visited Jan. 16, 2007, (4 pages).
"Scarne's Encyclopedia of Card Games," 1983, pp. 298-305, 383.
"Scarne's New Complete Guide to Gambling," Simon & Schuster, 1974, pp. 440-445.
Scarne, "Encyclopedia of Card Games" HarperCollins, 1973, chapter 1.
"Scarne's Encyclopedia of Games," Harper & Row, N.Y., p. 381 and title pages, copyright 1973.
"Show Five Cards", Scarne's Encyclopedia of Games, John Scarne, Harper & Row Publishers, pp. 28-29, 1973.
Scarne's Guide to Modem Poker, Constable and Company, Ltd. 1980, "Brag", pp. 159-160.
IGT, "Second Amended Petition" (for the Authorization for the Implementation of the Game of Progressive-21), State of New Jersey Casino Control Commission, PRN 217205, Civil Action, filed sometime after Aug. 4, 1991.
Three Card Poker Disclosure by Derek J. Webb.
"Tré Card StudTM Procedures Manual," Mikohn Gaming Corporation, Mar. 7, 2000.

* cited by examiner

FOUR-CARD POKER WITH VARIABLE WAGER OVER A NETWORK

CROSS-REFERENCE TO RELATED APPLICATIONS

This application is a continuation of U.S. patent application Ser. No. 14/034,295, filed Sep. 23, 2013, abandoned, which is a continuation-in-part of U.S. patent application Ser. No. 13/631,821, filed Sep. 28, 2012, abandoned, which is a continuation-in-part of U.S. patent application Ser. No. 11/499,864, filed Aug. 4, 2006, abandoned, which is a continuation of U.S. patent application Ser. No. 10/152,325, filed May 20, 2002, abandoned, the disclosure of each of which is hereby incorporated in its entirety herein by this reference. The subject matter of this application is also related to U.S. patent application Ser. No. 11/589,701, filed Oct. 30, 2006, now U.S. Pat. No. 7,584,966, issued Sep. 8, 2009, which is a continuation of the aforementioned U.S. patent application Ser. No. 10/152,325; to U.S. patent application Ser. No. 15/047,470, filed Feb. 18, 2016, which is a continuation of U.S. patent application Ser. No. 13/631,818, filed Sep. 28, 2012, abandoned, which is a continuation-in-part of the aforementioned U.S. patent application Ser. No. 11/499,864; to U.S. patent application Ser. No. 14/034,287, filed Sep. 23, 2013, now U.S. Pat. No. 9,126,102, issued Sep. 8, 2015, which is a continuation-in-part of the aforementioned U.S. patent application Ser. No. 13/631,818; to U.S. patent application Ser. No. 14/846,410, filed Sep. 4, 2015, abandoned, which is a divisional of the aforementioned U.S. patent application Ser. No. 14/034,287; to U.S. patent application Ser. No. 15/889,041, filed Feb. 5, 2018, which is a continuation of the aforementioned U.S. patent application Ser. No. 11/499,864; to U.S. patent application Ser. No. 15/898,549, filed Feb. 17, 2018, which is a continuation of the aforementioned U.S. patent application Ser. No. 13/631,821.

TECHNICAL FIELD

The present invention generally relates to a card game that can be played in a casino or in a card room. More particularly, it relates to a modified version of a stud poker game.

BACKGROUND

Many different wagering games presently exist for use in both home and casino environments. Such games should necessarily be exciting, uncomplicated, and easy to learn to avoid frustrating players. Designing new games that meet these criteria and are sufficiently different from old games to entice players to play the new games is a particular challenge.

BRIEF SUMMARY

A casino table poker game is played with poker hands of players competing against a poker hand of a dealer. A player enters the game by placing one or both of a bonus wager (also referred to as an "Aces Up" wager) for competition against a pay table and an ante wager for direct competition against the dealer. In some embodiments, the player also makes a mandatory super bonus wager to participate in the game. The player is dealt more cards than needed to form a poker hand. The dealer is also provided with more than the required number of cards, from which a number of cards is selected for the dealer hand to play. The player is provided with bonus payouts (e.g., multiple returns) on the bonus wager for ranked hands of a predetermined rank or better. The player hands also compete directly against the rank of the dealer hand if an additional play wager is placed to supplement the ante wager. The additional play wager may be varied by the player to be 1×, 2×, 3×, 4×, or 5× the amount of the ante wager. Limits may be placed on play wager amounts. Bonuses may also be paid on the bonus wager (such as the Aces Up wager) or the ante wager with unusually high-ranking player hands (such as a straight flush or a four-of-a-kind), whether or not the rank of the player hand exceeds the rank of the dealer hand.

Further embodiments may include one, some, or all of the following: The acts of the dealer may be carried out by a visual representation of a dealer, the visual representation being generated and/or displayed by a computer. The visual representation may be a virtual person (e.g., an animation) or may be a transmission (e.g., a video) of an actual person. The visual representation may be part of an online gaming experience of the disclosed game. The acts described in this disclosure as being associated with a dealer, including dealing cards, displaying or turning over cards, receiving or paying wagers, receiving game play elections, or any other actions, may be represented in any way when used in an online environment. For example, the cards associated with a dealer action, described as being dealt or otherwise handled by a dealer, may appear as virtual cards, as transmitted pictures of physical cards, or as cards that appear in a streaming video image of a live dealer dealing cards. This may include a display of virtual card decks, wherein each deck, individual card, and hand is displayed to an online player in a manner consistent with the game play disclosed herein, but may or may not include a visual representation of a dealer with the cards. Likewise, betting activity may be displayed in any manner to a player, including, but not limited to, virtual chips, betting pools, numbers, or other indicia of a wager amount.

The online experience may involve players playing remotely (e.g., in a different physical location) from the dealer, from the location of a game server, or from both, interacting through a networked connection that may include, but is not limited to, the Internet. The online game play may involve players who are also physically remote from each other. Remote connections may use networks involving several types of network links, including, but not limited to, the Internet. Networked connections allowing physically remote players to play a game using a game server or system may be part of an implementation of a virtual or online gaming environment.

The actions described in this disclosure as the acts of a player, including betting, card selecting (if any), card discarding (if any), or any other actions, may be carried out over a network, wherein the indicated actions are received as input to a user device. The input-receiving user device is typically physically remote from the game server or game host and is connected over a long-distance network, but it may also be implemented over a wired or wireless LAN in one building, or even in one room, for example. In one embodiment, game play generated at the server or host location may be displayed on the same device as the user device. In some embodiments, game play may be conveyed to remote players in devices separate from the devices receiving input from a player. For example, the game play may be conveyed to remote players by public screens or publicly broadcast data about a game coupled with individual or private user input devices. The reception of an input at a device may be accomplished through any technology adapted for such a purpose, including, but not limited to, keypads, keyboards, touchpads, mice, optical location devices, eye movement/location detectors, sound input devices, etc. When discussing a device, it is understood the device may comprise multiple components and be complex, including hardware components combined with firmware and/or software, and may itself be a subcomponent of a larger system.

Yet other embodiments may comprise apparatuses and systems for administering wagering games according to embodiments of the disclosure.

BRIEF DESCRIPTION OF THE DRAWINGS

While the disclosure concludes with claims particularly pointing out and distinctly claiming embodiments within the scope of the disclosure, various features and advantages of embodiments encompassed by the disclosure may be more readily ascertained from the following description when read in conjunction with the accompanying drawings, in which:

DETAILED DESCRIPTION

The illustrations presented herein are not meant to be actual views of any particular act in a method of administering a wagering game, apparatus for use in administering a wagering game, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix, should be considered as multiple instantiations of substantially similar elements and may be referred to generically without an alphabet character suffix. For example, elements 100*a*, 100*b*, and 100*c*, may be a device that is instantiated three times and referred to generically as element 100.

The terms "gaming," "gambling," or the like, refer to activities, games, sessions, rounds, hands, rolls, operations, and other events related to wagering games, such as web-based games, casino games, card games, dice games, and other games, the outcome of which is at least partially based on one or more random events ("chance" or "chances") and on which wagers may be placed by a player. In addition, the words "wager," "bet," "bid," or the like refer to any type of wagers, bets, or gaming ventures that are placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that are "play for pay" as well as "play for fun," as will be described in more detail below.

Figure 1:
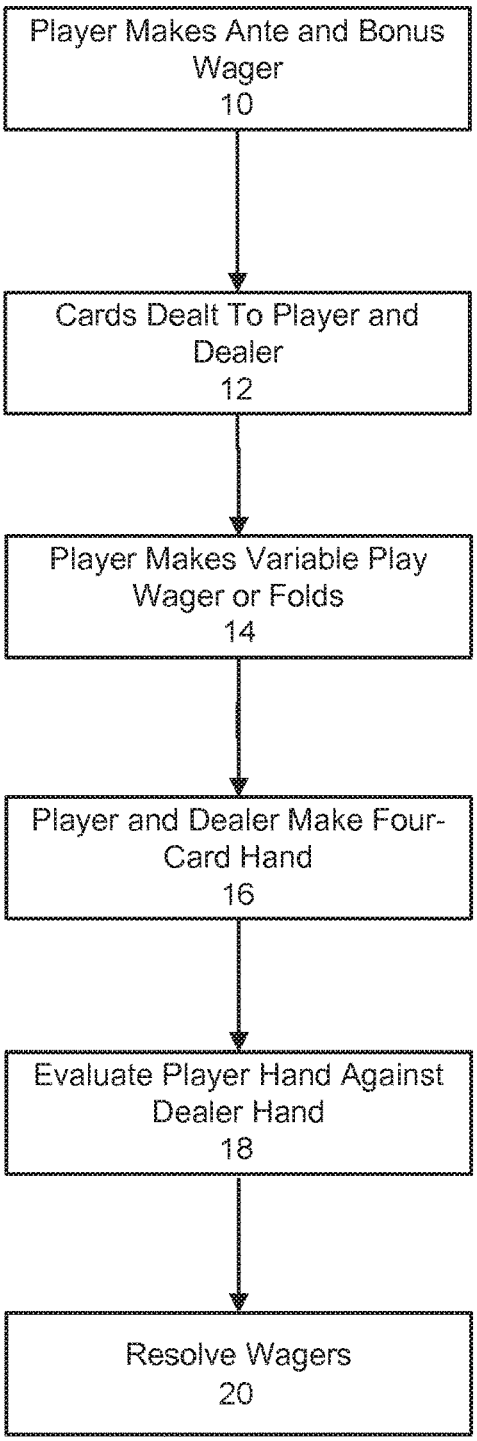
FIG. 1 is a flowchart diagram of a method of administering a wagering game.

Referring to FIG. 1, show is a flowchart diagram of a method of administering a wagering game. A card game is played by at least one player and a dealer. For simplicity in the following discussion, a single player's actions are described, though many players may play simultaneously. The dealer usually represents the house or the casino in the play of the game. In this embodiment, a player makes at least an ante wager and an equal bonus wager at the beginning of each round of play (operation 10). In this embodiment, the bonus wager is mandatory and equals the amount of the ante wager. This mandatory bonus wager equal to the ante wager is termed a "super bonus" wager, to distinguish this bonus wager from other bonus wagers described further below.

To initiate play of the game, at least one (and usually only one) deck of standard or variant playing cards is provided. In other forms of the game, multiple intermixed decks of cards, decks with wild cards, or special decks (i.e., decks with certain cards removed) are used. After placing at least the ante wager, cards are dealt to the player and to the dealer (operation 12). In one embodiment, the dealer is dealt five cards, and the player is dealt five cards. In other embodiments, the number of cards dealt to the player is unequal to the number of cards dealt to the dealer. In general, at least one card, in addition to the number of cards required to form a complete hand, is dealt to the player and to the dealer. In this embodiment, the player and dealer form four-card poker hands. In some embodiments, the player makes a best four-card hand, from the five available cards, though a user device. In other embodiments, a gaming system is able to assist the player by making the best four-out-of-five-cards poker hand.

After receiving the cards, the player determines whether to make a variable play wager or to fold (operation 14). The amount of the variable play wager, available for the player to make, varies based on the rules of the particular game. In this embodiment, the player may wager 1× to 3× the player's ante wager as a play wager, when the player hand meets a minimum qualifying rank, such as a pair of aces or better. When the player hand is less than the qualifying rank, the play wager must equal the ante wager. Alternatively, the player may fold, which forfeits the player's ante wager. Next, the player and the dealer each make a four-card hand based on the cards dealt to each (operation 16). That is, the player discards a card from the player's five cards, while the dealer discards one card from the dealer's five cards. The player's four-card hand is evaluated against the dealer's four-card hand (operation 18) using a four-card poker ranking to determine whether the player hand beats the dealer hand. The player's four-card hand is also evaluated against a paytable for the super bonus wager. Based on the evaluations, the wagers are resolved (operation 20). When the player hand beats the dealer hand, the player wins the ante wager and the play wager, and when the player hand does not beat the dealer hand, the player loses the ante wager and the play wager. If the player and the dealer tie, the ante wager and the play wager are resolved based on the rules of the game. For example, in one embodiment, the play wager is pushed, and the ante wager loses to the dealer when the player hand and the dealer hand tie. In another embodiment, when the player hand and the dealer hand tie, the ante wager and the play wager push.

The player's bonus wager is resolved based on the applicable paytable and the strength of the player hand. For example, in one embodiment, the bonus wager is paid based on premium hands, such as a four-of-a-kind or a straight flush. In one embodiment, if the player wins the ante wager and the play wager, but does not qualify for the paytable of the bonus wager, the bonus wager pushes and is neither won nor lost. In yet other embodiments, the bonus wager pushes if the player hand is not a predetermined winning hand but the player hand beats the dealer hand.

Additional variants and embodiments of four-card wagering games are described below. In the description that follows, games described may include or may not include the super bonus wager described above. While generally describing four-card wagering games, these methods of play are not limited to games using four-card hands and are more generally applicable to games using more or fewer cards to form a hand. These wagering games may include more or fewer cards dealt to a player and with additional or fewer wagers placed by the player, such as an additional bonus wager, as further described below.

Figure 2:
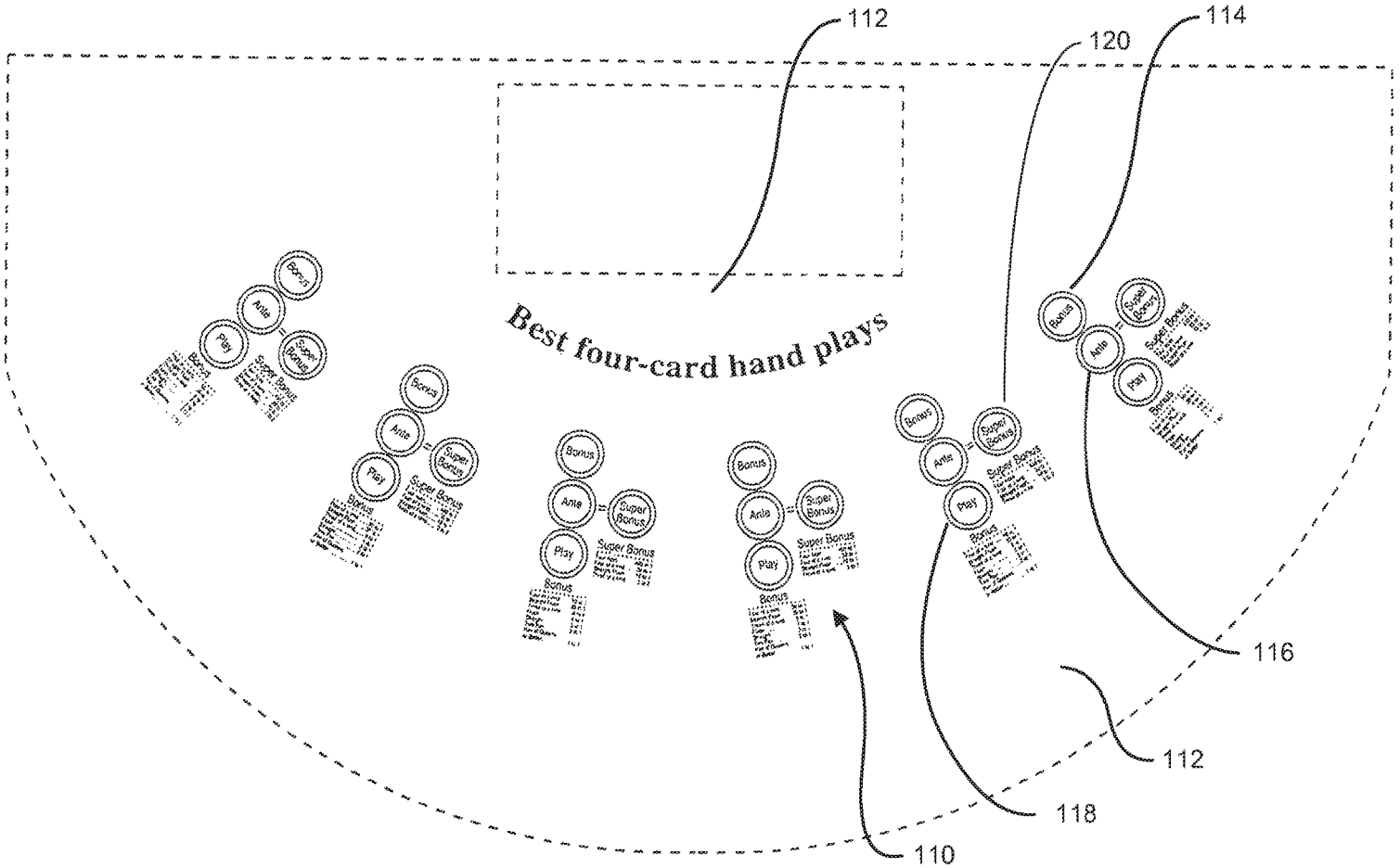
FIG. 2 is a diagram of a playing surface for implementation of the wagering game.

Referring to FIG. 2, shown is a diagram of a playing surface for implementation of the wagering games within the scope of the present disclosure. A player position 110 is provided for each player, and card-receiving areas 112 are available for each of the players and the dealer. The player position 110 may include three distinct wagering zones, including a bonus wager area 114 (also termed an "Aces Up" wager area), an ante wager area 116, and a play wager area 118. The player position 110 may also include a super bonus wager area 120. Each player who wishes to enter the play of the game makes at least one wager selected from the bonus wager (or Aces Up wager) and the ante wager. One or both of these wagers may be made. The player may also play the hand blind (also referred to as the "house way") by placing both an ante wager and an additional play wager (also referred to as the "game wager"). The player may also bet the super bonus wager, which, in some embodiments, is a mandatory bet.

Figure 3:
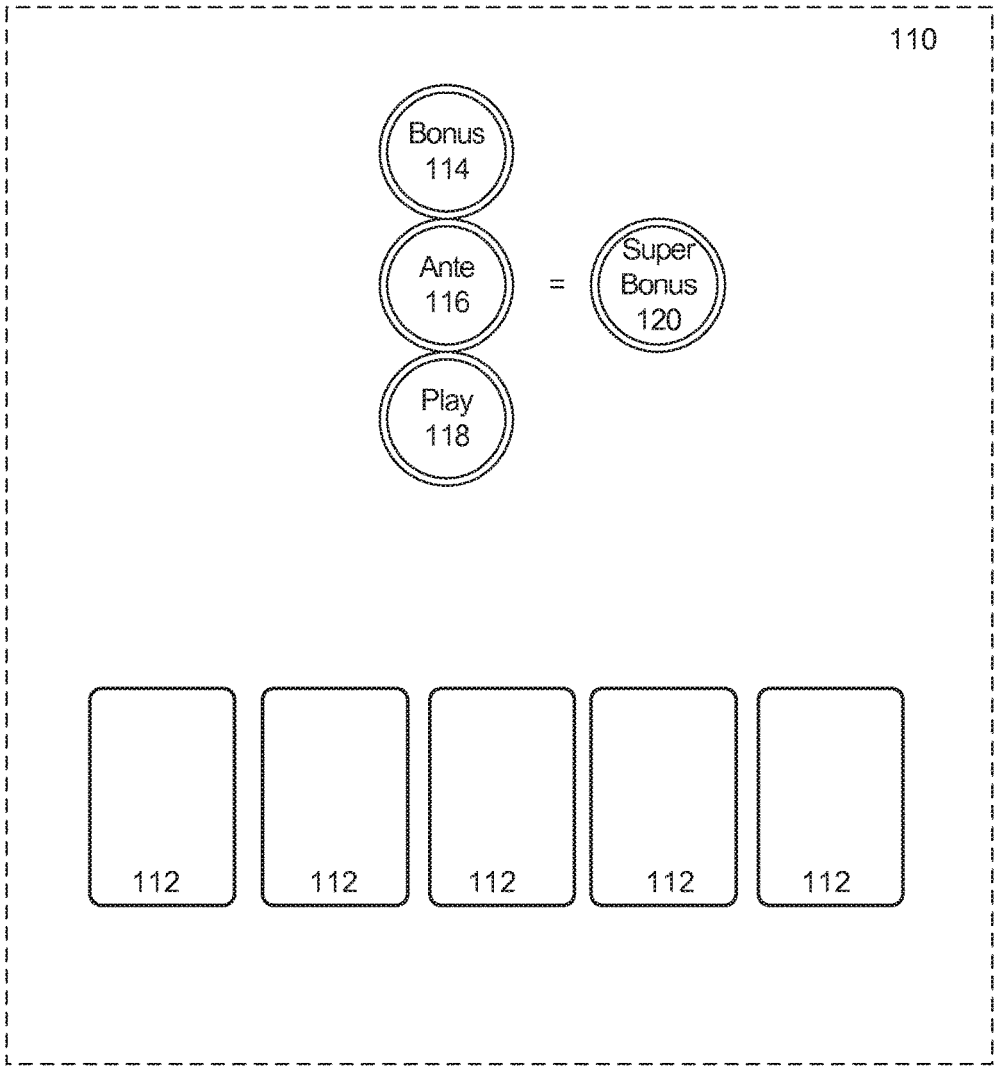
FIG. 3 is an enlarged diagram of one of the player positions of the playing surface of FIG. 2.

Referring to FIG. 3, shown is an enlarged diagram of one of the player positions 110 of the playing surface of FIG. 2. In one embodiment of the player position 110, the card-receiving areas 112 include an area for each card received by a player, in this case five cards. In other embodiments, the card-receiving areas 112 are not marked or are marked with multiple cards together in one location. Also shown in this embodiment is the super bonus wager area 120 for a wager termed a "super bonus" wager. This super bonus wager may be used in certain embodiments of the described wagering game and may not be used in other embodiments. When the super bonus wager is used, it is generally equal in amount to the ante wager (at the ante wager area 116), as indicated on the player position 110. When the super bonus wager is not used, the super bonus wager area 120 may be omitted from the player position 110. Though not shown in FIG. 3, a pay table may also be provided at each player position 110, when the game is played at a table, and may be accessible on a display when the game is played electronically.

After placement of the at least one wager, each player who has made at least one wager is provided with five cards, in this embodiment, from which to select a best four-card poker hand. The cards may be dealt as a complete set of five cards or in portions of one or more cards. At about the same time, the dealer is dealt a number of cards exceeding four. In one embodiment, six cards are dealt to the dealer. One or more additional cards can be dealt to the player, to the dealer, or to both.

Although, in one example, the dealer receives one more card than each player, the number of cards dealt can be equal. In particular, enough cards are dealt so that at least one discard can be made.

In an embodiment, a four-card poker hand is played. The player reviews the five cards received at his or her player position 110 and determines what best four-card poker hand can be made from the five cards. If the player believes that the cards cannot form a four-card poker rank of sufficiently high rank to warrant competition against the dealer hand (even without that hand or any portion of that hand having been displayed), the player may fold the hand, refusing to place an additional wager. At this time, or usually at a later time, the ante wager would be collected by the dealer. In one example, if the player made the Aces Up wager and the ante wager and decides to fold, the Aces Up wager is swept along with the ante wager. In another embodiment, if the player remains in the game by making the play wager and the player hand does not contain a hand ranking of a pair of aces or higher, and a wager was made on the Aces Up wager, that wager may now or later be collected by the dealer. If the player determines that the rank of the best four-card poker hand that can be made from the five cards dealt to the player is sufficiently high as to warrant competition against the dealer (or if the player wants to "bluff" against the dealer, particularly if the dealer must qualify), the player makes an additional wager, referred to as a "play wager" or a "game wager." That additional wager may be a multiple of the ante wager, such as 1×, 2×, 3×, 4×, or 5× the amount of the original ante wager, at the option of the player. In some embodiments, the game wager is 1× the ante wager unless the player has a qualifying hand, such as a pair of kings or better, for example. If the player hand qualifies, the player has the option of increasing his or her wager. Fractional amounts or larger amounts may be allowed, but they can complicate the payout or alter the hold for the house; so, those changes are in the discretion of the casino. After placing the game wager and discarding excess cards, placing the fifth card face down, or merely leaving the fifth card in the hand so that the hand may be arranged and ranked by the dealer or the player when exposed, the player hand is placed on the table for display. The dealer hand is then revealed after each and every player has determined whether or not the game wager is to be made. The dealer compares the value or rank of his or her hand against the value or rank of each player hand, usually in succession around the table, and each series of wagers (the Aces Up wager, the ante wager, and the game wager) is resolved. Ties on the rank of the player hand and the dealer hand may be paid to the player, be called a push, or be collected by the dealer, depending upon the desired house advantage the casino wants to build into the game. The dealer may either always qualify to play or a level of qualification may be built into the game (such as at least queen high, at least king high, at least queen-jack, at least king-jack, at least ace-king, or at least one pair).

Resolution on the wagers may be based upon pay tables for the Aces Up wager, pay tables on the ante wager, and/or the game wager. One embodiment of play of the game provides pay tables for one or more of the Aces Up wager, the ante wager, and an automatic bonus payout on the ante wager. The game wager pays one-to-one with a player win. Because the player can see the strength of the player hand when making the game wager, the player would be at an extreme advantage in placing a 5× game wager, assuring a very high multiple payout, with essentially no risk or little risk involved in the placement of the 5× game wager. The payout of wagers may be tailored by the casino by selecting pay tables designed for greater player payouts or greater casino earnings.

Although a four-card poker game is one embodiment, the game could also be played with three, five, or seven cards, with necessary adjustments to the pay tables.

For example, in a four-card game, the hierarchy of hands is as follows:

Four-of-a-Kind
Straight Flush
Three-of-a-Kind
Flush
Straight
Two Pair
Pair
High Card.

A three- or five-card game may require a different hierarchy of hand rankings.

There are many variations of the game that may be played. The following variations on the format described above illustrate the expanded scope of play available under various methods.

Version I—

Each player receives five cards, and the dealer receives six cards. The players and the dealer each identify his or her best four-card poker hand. The players may rely upon the house for assistance, if needed. The dealer always qualifies. That is, the dealer hand and any player hand are always in play if the ante wager is made. Players have the choice of placing one or both of the ante wager and a bonus wager (e.g., the Aces Up wager). House rules may require the player to make the ante wager, the bonus wager, or both the ante wager and the bonus wager. The ante wager is a wager directly against the rank of the dealer hand, and the Aces Up bonus wager is a wager against a pay table. If, after viewing his or her hand, a player chooses to stay in the game against the dealer (keeping the ante wager in play), the player must make an additional game wager to stay in the game. This game wager may be, for example, between 1× and 5× (or between 1× and 4×, or between 1× and 3×) the amount of the initial ante wager at the opinion of the player. In other forms of the game, the player's game wager must be 1× the ante wager unless the player holds a qualifying hand of a pair of aces or better. If the player has a qualifying hand, he or she can bet up to 3× the ante wager. The player must hold a pair of aces or better to win on the bonus wager (hence the name "Aces Up") in this embodiment. The bonus wager pays a maximum return of 50:1, in one embodiment, but payouts may theoretically be as high as 500:1 for certain hands, such as for four aces. The bonus wager side wager game may or may not be present in the rules of the game. In this example, the game pays an automatic bonus for certain high-ranking hands according to a payout schedule. This bonus is paid on the ante wager and does not require the player to make a separate wager to qualify for this payout. For example, automatic bonuses are paid on a three-of-a-kind, a straight flush, and a four-of-a-kind.

Version II—

Each player and the dealer get five cards to make the best four-card poker hand. If the dealer hand does not equal or exceed a certain rank (e.g., a pair of twos or better), he or she discards all cards, draws a new five-card hand, and makes a four-card poker hand from the five cards. The player must make the ante wager to be in the game against the dealer. The dealer always qualifies to play against the player. It is possible to allow the player, or require the player, to make the ante wager 1) before the deal of cards, 2) after the deal of cards but before any cards are revealed, 3) after the deal of cards and after the player has reviewed his or her cards but before the dealer has exposed cards, 4) after the deal of cards and a partial or complete revelation of the dealer's five cards (but before review of the player's cards), or 5) after the deal of cards and a review of the player's cards and a partial revelation or a complete revelation of the dealer's five cards, which play might be restricted to when the dealer has not qualified (but not after revelation of any sixth card). The player hand may be required to exceed a minimum rank to bet more than 1× the ante wager. For example, if the player has a qualifying hand of a pair of kings or better, the player can make a game wager of 1×, 2×, or 3× the ante wager. As with Version I, the rules can provide that the bonus wager (side wager) is mandatory or that both initial wagers (the ante wager and the bonus wager) are mandatory. The automatic bonus against a pay table on the ante wager may or may not be present in the rules of the game. The bonus wager game may or may not be present, also, in the rules of the game. In this example, a pair of aces or better qualifies the player for an Aces Up payout of 1:1. The automatic bonus pays even if the player hand is lower in rank than the dealer hand.

Version III—

The players and the dealer each receive five cards to make his or her best four-card poker hand. The betting/wagering rules and procedures are the same as in the previous versions, except for those listed below. Either the ante wager is mandatory, the ante wager or the bonus wager is mandatory, or both initial wagers are mandatory. The dealer must qualify to play (for example, with a hand of ace high or better, king-queen or higher, ace-king or higher, a pair of twos or higher, etc.). The automatic bonus against a pay table is present in the rules of this example of the game.

If the player stays in the game, the player can bet 1× to 3× the ante wager if the player has a qualifying hand of a pair of kings or better. Otherwise, the maximum game wager is 1× the ante wager. The lowest ranking hand that qualifies for the bonus payout is a pair of aces or better.

Version IV—

Four-Card Poker with Super Bonus—The dealer and each player are dealt five cards each. The cards are used to make the best four-card poker hand by the players and the dealer. The hands are ranked according to the following four-card poker ranking schedule:

Four-of-a-Kind
Straight Flush
Three-of-a-Kind
Flush
Straight
Two Pair
Pair
High Card.

Players can make a bet against the dealer (ante wager), a bet against the pay table (Aces Up bonus wager) or both. House rules may require one or both wagers to be mandatory. In addition, the players are required to make a super bonus wager in an amount equal to the ante wager, in this version.

Players place equal wagers on the ante wager area 116 and/or the super bonus wager area 120 and/or the bonus wager area 114 on the layout. After viewing the cards, the player must fold or place an additional wager (play wager). If the player hand does not qualify with a pair of kings or better, the player must bet 1× the ante wager to stay in the game. With a qualifying hand of a pair of kings or better, the player can bet an amount equal to or multiples of the ante wager, such as 1×, 2×, or 3× the ante wager.

If the player has a higher-ranking hand than the dealer hand, the player is paid 1:1 on the ante wager and the play wager. If the dealer hand outranks the player hand, the player loses the ante wager and the play wager.

The player has the option (or may be required), at the beginning of the game, to place an Aces Up bonus wager. In this example, the player wins a bonus payout for a pair of aces or better. If the player makes the ante wager and the play wager and beats the dealer, but does not have a pair of aces or better, the player pushes on the bonus wager. The player is always paid on the Aces Up bonus wager, regardless of whether or not the player hand beats the dealer hand.

In addition, this example includes a mandatory super bonus wager that is made in an amount equal to the ante wager. The player wins a payout for certain high-ranking hands, such as a straight flush or a four-of-a-kind. A pay table is provided on the layout to identify winning hands and payout amounts.

A failure to obtain a "super bonus" hand does not result in an automatic loss of the wager. For example, when the player hand against the dealer does not qualify with a pair of kings or a straight flush or better, but the hand still beats the dealer, the super bonus wager pushes. But, if the player folds on the ante wager or loses the ante wager and the play wager against the dealer, the super bonus wager is also lost.

The super bonus wager is desirable in some instances where it is desired to provide the house with more of an advantage. In this example of the game, removing the mandatory super bonus wager causes the game to favor the player. However, other rule changes, such as requiring the dealer to qualify or raising the minimum qualification hand ranking when making the play wager, are other means to shift the odds to favor the house.

There are a number of advantages of the games as described herein. The fold rate for a player using good strategy on this game is approximately 21%, which is lower than the fold rate in some other games. This feature is believed to attract and retain players, making the game more appealing to casinos.

Players win this game approximately 48% of the time, which exceeds the expectation of many players and increases player appeal.

In some situations, e.g., when the player has a qualifying hand, additional betting opportunities are available, such as tripling down on the ante wager, increasing player appeal.

By varying the number of cards made available to the dealer and/or players in forming the hands, by requiring the dealer hand to qualify, by eliminating dealer qualification, by modifying the payouts and winning hand combinations possible on the bonus wager, by adding the super bonus wager, etc., the payouts can be made to pay as high as 500:1, e.g., for a four-of-a-kind hand. This feature is believed to attract and retain more poker players.

Various platforms are contemplated that are suitable for implementation of embodiments of wagering games according to the present disclosure. For example, embodiments of wagering games may be implemented such that one or more players may place wagers and engage in game play according to the rules of the wagering games. For example, wagering games may be implemented on gaming tables, which may include physical gaming features, such as physical cards, physical chips, and may include a live dealer and a shuffler or shoe. More specifically, a live dealer may deal physical cards, accept wagers, issue payouts, and perform other administrative functions of game play. Some embodiments may be implemented on electronic devices enabling electronic gaming features, such as providing electronic displays for display of virtual cards, virtual chips, game instructions, pay tables, etc. Some embodiments may include features that are a combination of physical and electronic features.

As an example, embodiments of wagering games may be implemented on an individual gaming device for accepting wagers, and the individual gaming device may have a display screen and input devices for enabling game play of the wagering games. Such an individual gaming device may be linked with other gaming devices that may be operated, for example, by other players. Some individual electronic gaming devices may be referred to as individual player "cabinets" and may be stationary, such as being located on a casino floor. Other individual electronic gaming devices may be portable devices that may be carried to different locations by the player. A portable device may include both display of the ongoing game play and input reception for game play by a player, and it may be configured for receiving input from a player while the game play is displayed on a public monitor or other display device. Game play and game outcomes may also be displayed on a portable device.

As previously noted, the present games and rules may be played as live casino table card games, as hybrid casino table card games (with virtual cards or virtual chips), on a multi-player electronic platform (as disclosed in U.S. patent application Ser. No. 10/764,827 (published as U.S. Patent Application Publication No. 2005/0164759 A1 on Jul. 28, 2005) (now abandoned); Ser. No. 10/764,994 (now U.S. Pat. No. 7,661,676, issued Feb. 16, 2010); and Ser. No. 10/764,995 (now U.S. Pat. No. 8,272,958, issued Sep. 25, 2012), all filed on Jan. 26, 2004, the disclosure of each of which applications is hereby incorporated herein in its entirety by this reference), on a personal computer for practice, on a hand-held game for practice, or on a legally authorized site on the Internet.

In one embodiment, the players are remotely located from a live dealer, and the players observe a live dealer and a game table on their monitors via a video feed. The players' video feeds may be transmitted to the dealer and may be shared among the players at the table. In a sample embodiment, a central station includes a plurality of betting-type game devices and an electronic camera for each game device. A plurality of player stations may be remotely located with respect to the central station. Each player station may include a monitor for displaying a selected game device, of the game devices at the central station. Each player station may also include input means for selecting a game device and for placing a wager by a player at the player's station relating to an action involving an element of chance to occur at the selected game device. Further details on gambling systems and methods for remotely located players are disclosed in U.S. Pat. No. 6,755,741 B1, issued Jun. 29, 2004, titled "Gambling Game System and Method for Remotely-Located Players," the disclosure of which is incorporated herein in its entirety by this reference, and in connection with FIGS. 9 and 10.

In some embodiments, the wagering games described herein may be played against the house (i.e., be "house-banked"), which may involve playing against a dealer hand or a pay table, with payouts on wagers being paid by a casino or other gaming establishment and losses on wagers being collected by the casino or other gaming establishment. For example, payouts associated with the ante wager, play wager, bonus wager, and (if applicable) super bonus wager may be banked by the house and payouts made by the house. In the house-banked game, the player hand is played against the dealer hand, wherein the player's four-card hand is compared against the dealer's four-card hand. When the player makes an ante wager and makes a play wager, these wagers may be resolved against an account of the house, such as a dealer adding player chips to a chip rack of the house or adding chips to the player stacks from the chip rack of the house.

In other embodiments, the wagering games, or at least one wager associated with the wagering game, may enable players to play against one another (i.e., be "player-banked" or "player-pooled"), with payouts on wagers being paid from a pot and losses on wagers being collected by other players. Player-banked games allow a player or a professional banker to take all other player losses and pay payouts to players. In a player-banked version of a game of the present disclosure, a house may provide a dealer to administer the game and may rake wagers made, may rake payouts won, or may charge a flat fee for playing the game. Player-banked games are typically offered as live table games in card rooms where house-banking gaming is not permitted by local gaming regulations. Player-pooled variants of games may be offered as live table games, but they are more typically offered in an electronic format, wherein tracking the value of a jackpot pool is conducted using computer-controlled equipment. Player-pooled variants are particularly useful when regulators of online casino play permit the play of "poker."

Figure 4:
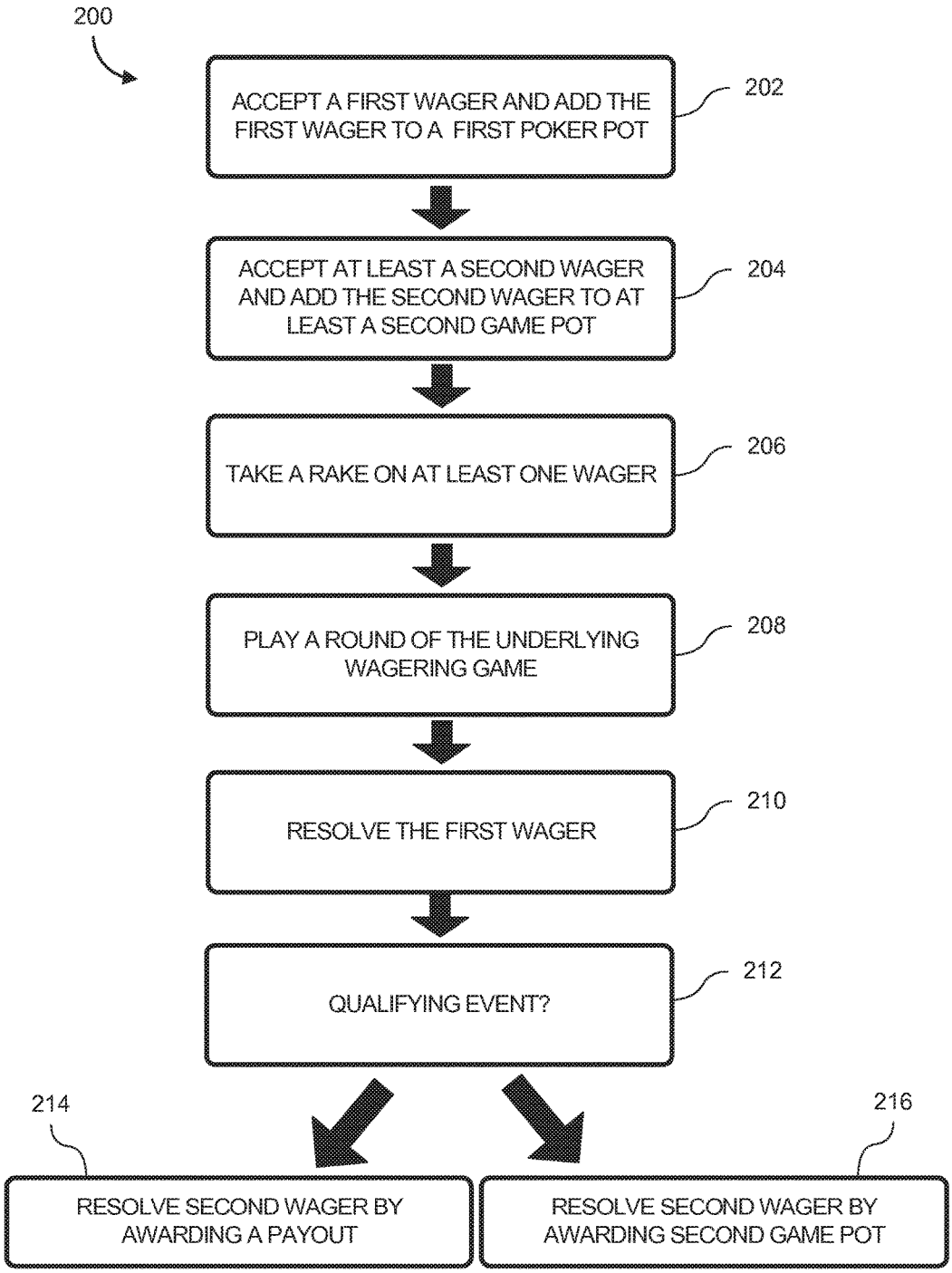
FIG. 4 is a flowchart diagram of a method of administering a wagering game that may be at least partially player-pooled.

Referring to FIG. 4, shown is a flowchart diagram of a method 200 of administering a wagering game, which may be at least partially player-pooled. The method 200 includes accepting a first "poker" wager from a player and adding the first poker wager to a first poker pot (e.g., a pool or accumulation of bets), as indicated at operation 202. The wagers contributed to the poker pool may be raked, in one example of the invention.

A second wager may be received at operation 204. The second wager may comprise, for example, a base game wager (e.g., ante wagers, blind wagers, play wagers, raises, and other wagers made on the underlying wagering game) or a side wager. Second wagers may be raked. Alternatively, payouts on second wagers may be raked. More specifically, the second wager may comprise, for example, the ante wager and any of the play wagers, or a separate pay table or progressive side wager. The second wager may be accepted, for example, by performing any of the acts described previously in connection with FIG. 1. In one example, the second wager may comprise all wagers made in any of the four-card games described above, and the first wager may be an additional "poker" wager. The first poker pot may be non-progressive, meaning that the entire value of the pot is distributed to a player at the conclusion of a round of play. If two players tie with a highest-ranking hand, the poker pot may be split. In other embodiments, the player holding the highest-ranking hand is awarded a percentage of the pot, and a player holding a second highest-ranking hand is also awarded a percentage of the pot. An exemplary split between highest and next highest hand is 80/20, for example.

The second pot may be separate from the first pot. For example, the first and second pots may include chips located in separate areas on a gaming table when the wagering game is conducted live in a casino. As another example, the first and second pots may be displayed as separate amounts on one or more video displays (gaming screen 374 (FIG. 5), playing surface 404 (FIG. 6), player interface 416 (FIG. 6), dealer interface 418 (FIG. 6), upright display 430 (FIG. 6), player interface area 532 (FIG. 7), dealer screen 560 (FIG. 7), card screen 564 (FIG. 7), and display 758 (FIG. 10)) (e.g., a monitor) controlled by one or more processors (control processor 350 (FIG. 5), local game processor 414 (FIG. 6), central game processor 428 (FIG. 6), control processor 597 (FIG. 7), and processor 742 (FIG. 10)) and may be maintained in separate accounts when the wagering game is conducted online. The second wager may enable a player to be eligible to win an additional award, such as, for example, a progressive payout for a predetermined premium hand.

In one embodiment, all odds payouts are paid out of the second pot, and all losses are accumulated in the second pot. When a predetermined event occurs, such as a player holding a predetermined premium hand, such as a royal flush in hearts, for example, the administrator of the game may, at operation 214, award the entire second pot to the player holding the premium hand.

In other embodiments, all normal game wagers, such as the ante wager and all play wagers in the present game, are placed in the second pot, and all payouts are made from the second pot. Excess amounts that grow in the pot are redistributed to players in the form of a dividend distribution (e.g., a share of the second pot awarded to each participating player) from the second pot. The second wager may comprise, for example, the ante wager or any of the play wagers.

In some embodiments, the second wager may be a mandatory wager. In other embodiments, the second wager may be optional, and a player wishing to play the poker wagering game may do so by placing a wager in the first pot without placing the second wager and without being eligible to win any award from the second pot. In some embodiments, the second wager may include multiple sub-wagers. For example, the second wager may include an ante wager, a first play wager, a second play wager, and a third play wager. In other embodiments, a third pot (not shown) for participating in a progressive side wager game is provided. Such third pots may be separate from the other pots or may be combined with one of the other pots. The second wager may be accepted, for example, by performing any of the acts described previously in connection with FIG. 1.

In some embodiments, the second pot may be a pooled or linked pot. For example, the second pot may include second wagers accepted from multiple concurrent wagering games, which may include only second wagers from those wagering games currently being played or may include accumulated second wagers from past wagering games. As specific, nonlimiting examples, the second pot may include all second wagers accepted from a group of tables or local wagering game administration devices at a casino, from multiple groups of remote devices connected to network gaming architecture, or from both. In other embodiments, the second pot may not be pooled, and awards for the second wager may be limited to the amounts wagered at a respective table, local wagering game administration device, or group of remote devices.

A rake (e.g., a commission for the house) may be taken on at least one of the first and second wagers, as indicated at operation 206. For example, the house may collect a portion of the second wager at the time the second wager is placed or may collect a portion of amounts awarded from the second pot at the time the second pot or a portion of the second pot is awarded. The rake may comprise, for example, a fixed percentage of the second wager. More specifically, the percentage of the second wager collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last five, ten, or fifteen years for a given casino or other gaming establishment). As specific, nonlimiting examples, the percentage of the second wager collected for the rake may be between 3% and 8%, between 4% and 7%, or between 5% and 6%. In other embodiments, the portion of the second wager collected for the rake may comprise a variable percentage of the second wager or may comprise a fixed quantity (e.g., a flat fee) irrespective of the total amount for the second wager, a fixed percentage with a cap, or a time-based fee for increments of time playing the wagering game.

In some embodiments, all profits for the house may be made from the rake. In such embodiments, all second wagers in excess of the rake may be redistributed back to the players, rather than be collected by the house as additional revenue. Such limiting of profits for the house and redistribution of second wagers back to the players may increase the attractiveness of the wagering game to both inexperienced and highly skilled players. Because the amount earned by the house is known, highly skilled players may perceive that their skill will enable them to increase winnings, and inexperienced players may be enticed by the possibility of winning the second pot or a portion thereof. In other embodiments, the house may make profits on the rake and on losses from one or more of the wagers (e.g., ante and play wagers), including losses resulting from optimal and sub-optimal play. The rake may be maintained in a rake account, and profits for the house may be deducted from the rake account. The rake may be taken by, for example, electronically transferring funds from the second pot to a rake account (e.g., as instructed by a game server 606 (see FIG. 8) using casino account servers 610 (see FIG. 8)) or physically removing or exchanging money or representations of money from the second pot on a live table.

A round of the underlying wagering game may be played, as indicated at operation 208. For example, the underlying wagering game may be played at least substantially as described previously in connection with FIGS. 1 through 3. In one embodiment, an additional side wager is played between players, rather than against a pay table. The additional side wager may be a fixed amount, such as an amount equal to the ante wager. The additional side wager is added to a first pot that is completely distributed at the end of each round of play. The distribution of the additional side wager may be based, for example, on the highest player hand at the conclusion of the game. The ante and play wagers are added to a second progressive pot for distribution based on the pay table. In this way, the first pot allows the players to compete based on hand strength against other players, while the second pot is able to support larger progressive awards based on a pay table.

At the end of a round of play, the first wager may be resolved and at least a portion of the first pot may be awarded to at least one player, as indicated at operation 210. Each successive round of making wagers, dealing cards, and resolving wagers may constitute a round of play, and the first pot or a portion of the first pot may be awarded to at least one player at the end of each round of play. The player to whom the first pot or the portion of the first pot is awarded may hold a winning hand or at least a tying hand for that round of play according to the rules of the underlying wagering game. Awarding the first pot or the portion of the first pot may comprise crediting a player account of each wining player or may comprise distributing physical money or physical representations of money to each winning player.

In some embodiments, an entire amount of the first pot may be awarded to at least one player at the end of each round of play. In such embodiments, the first pot may be a non-progressive pot. Awarding the entire first pot to at least one player at the end of each round of play may enable the wagering game to qualify as a legal form of online "poker" play under some relevant statutes. For example, games that require a mandatory pot bet that may or may not be raked, that have no house advantage, and that put all other bets into a second pot that is raked may qualify as "poker" to gaming authorities, especially for online versions of the games. Awarding the entire amount of a first pot to at least one player at the end of each round of play redistributes lost first wagers attributable to suboptimal play to other players, rather than to the house. Accordingly, such a wagering game may be particularly attractive to players who perceive themselves as being highly skilled in the wagering game and, therefore, more able to take advantage of suboptimal play by other players. In some embodiments, a portion of the first pot may be awarded to at least one player at the end of each round of play. For example, the house may take a rake on the first wager, which may still enable the wagering game to qualify as a legal form of online gambling under some relevant statutes. The rake taken may comprise, for example, between 1% and 8%, between 2% and 6%, or between 3% and 5% of the first wager. The rake amounts on each wager may be more than, less than, or equal to the rake taken on other wagers in some embodiments. In still other embodiments, a portion of the first pot may remain in the first pot or be redistributed to another pot (e.g., the second pot) to be awarded in a subsequent round of play as a progressive payout or a dividend distribution. In such an example, the portion of the wager remaining in the first pot or redistributed to another pot may comprise, for example, a fixed percentage of the first wager, a variable percentage of the first wager (e.g., an odds payout may be awarded and the remainder retained in the first pot or redistributed to the other pot), or a fixed amount.

In lieu of, or in addition to, a rake taken on one or more wagers or from winnings, the house may be compensated in a number of other ways, including, without limitation, a flat fee per round of play, a percentage of wagers made with or without a cap, rental of a player "seat," or otherwise as is known in the gaming art. All such compensation may be generally referred to as a "commission."

All or portions of the second pot are distributed when there is a qualifying event, as indicated by operation 212. In embodiments in which the second pot is a progressive pot, at least a portion of the second pot may be awarded to at least one player when a predetermined non-premium winning hand combination is dealt, as indicated at operation 214, or when a premium winning hand composition is dealt, as indicated at operation 216. The second pot may not be awarded at the end of each round of play, but may grow during each successive round in which no player is dealt a premium winning hand combination. Awarding the second pot or a portion of the second pot may comprise crediting a player account with funds from the second pot or may comprise distributing physical money or physical representations of money from the pot to the player. In some embodiments involving a no-house-advantage first pot awarded at the end of each round and a progressive second pot that receives all other game bets, all players participating in the wagering game who have made the second pot wager may be eligible to win the second pot or a portion of the second pot. Players who are ineligible to win the first pot, and players who have folded but still have one or more other active bets in play, may be eligible to win the second pot or a portion of the second pot.

A predetermined winning hand combination may comprise, for example, a four-of-a-kind, a full house, a flush, a straight, a three-of-a-kind, two pair, or one pair. The hands qualifying as new winning hand combinations may be predetermined at the beginning of each round of play in some embodiments. In other embodiments, new winning hand combinations may be predetermined at the beginning of play and may remain fixed until at least one player achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

A premium winning hand composition may comprise, for example, a four-of-a-kind, a straight flush, a royal flush, or a royal flush of a certain suit. The hand compositions qualifying as premium winning hand compositions may remain fixed throughout the duration of the wagering game or may change during the wagering game. For example, after a player has achieved a premium winning hand composition, the hand compositions qualifying as premium winning hand compositions may be made more restrictive or less restrictive. As a specific, nonlimiting example, after a player has achieved a straight flush, the hand compositions qualifying as premium winning hand compositions may be restricted to royal flushes or may be expanded to include four-of-a-kinds. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the second pot is a progressive pot, the amount awarded from the second pot for achieving a premium winning hand composition may be a progressive payout at least as great as a maximum progressive payout for achieving a predetermined winning hand composition. For example, the entire second pot may be awarded when a player or multiple players are dealt a premium winning hand composition, and only a portion of the second pot may be awarded when a player or multiple players are dealt a predetermined winning hand combination.

In embodiments, the qualifying event at operation 212 is based on a predetermined event that is not based on hand composition. In embodiments in which the amount of the second pot is adjusted using a dividend refund method, the second pot, less the rake, may be distributed among the players upon the occurrence of a predetermined event. The predetermined event may not be based, for example, on player skill or chance events occurring in the underlying wagering game. The predetermined event may comprise, for example, the expiration of a time limit or the amount of the pot reaching a certain threshold amount. The pot, which has already been raked, less a minimum seed amount, is divided pro-rata between players who are currently participating, to players who contributed to the pot, or to players according to another distribution method. The distribution can take the form of a debit to a player account, and the distribution does not take place as part of a game play event. Players may receive dividend refunds on play conducted on a live gaming table, on a game administered by an electronic gaming machine, or on a game administered by a remote gaming device.

In some embodiments, the dividend distributions may not be paid to players who have not contributed to the second pot since the last dividend distribution was paid. The percentage of the second pot, less the rake, paid to each player as a dividend distribution may be, for example, approximately equal to the percentage of hands won by each player, the percentage of first pot winnings won by each player, the percentage of total amounts wagered by each player, the proportional number of wagers made by each player, the proportional length of time spent playing the wagering game by each player, or an equal percentage for each player eligible to receive a dividend distribution from the second pot.

Alternatively, the second pot and/or any other pots may be distributed (wholly or partially) in response to a predetermined event or condition. The predetermined event or condition may be time-based, pot-based (or pool-based), game-based, or other. Further details on pot distributions based on predetermined events and conditions are disclosed in the U.S. patent application Ser. No. 13/871,824, filed Apr. 26, 2013, titled "Distributing Supplemental Pot in Wagering Games Based on Predetermined Event" (now U.S. Patent Application Publication No. 2013/0296025 A1, published Nov. 7, 2013), the disclosure of which is incorporated herein in its entirety by this reference.

In some embodiments, the second pot may be seeded with money from the rake account or reserve account at the beginning of play, after the second pot or a portion of the second pot has been awarded, or both. For example, the second pot may be seeded from the rake account of the house, and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game and specifically to place the second wager to be eligible for the second pot. In addition, such seeding may reduce the likelihood that the amount of funds in the second pot may be insufficient to cover all the payouts to players. For example, where a player achieves a premium winning hand composition in one round of play, a player achieves a predetermined winning hand combination in the immediately following round of play, and a fixed odds payout is to be awarded to the player holding the predetermined winning hand combination, the amount seeded to the second pot between those rounds of play may be at least as great as the maximum fixed odds payout awardable for any predetermined winning hand combination. The second pot may be seeded each time the second pot is awarded in its entirety or each time the amount in the second pot is lower than the maximum fixed odds payout.

As a specific, nonlimiting example, a player-banked wagering game may comprise receiving an ante wager and additional side wager from a plurality of players. The additional side wager is added to a first poker pot that is not raked, has no house advantage, and is completely distributed to the players after each round. The ante wager and any subsequent play wagers may be added to a second game pot having a progressive payout for achieving a predetermined rank, such as a rank listed on a pay table as described above. After placing the ante wager and, optionally, an additional side wager, the game is played as described above. Additional wagers in the hand are added to the second pot. After completing the hand, the first pot is awarded to the player remaining in the hand with the highest hand. The second pot is a progressive pot and awards a hand that matches a pay table.

As another specific, nonlimiting example, a player-banked wagering game may comprise receiving an ante wager and additional side wager from a plurality of players. The additional side wager is added to a first pot that is not raked, has no house advantage, and is completely distributed to the players after each round. The ante wager and any play wagers are added to a second pot having a dividend payout for reaching a predetermined event. After placing the ante wager and additional side wager, the play of a game round is provided as described above. Any additional wagers are added to the second pot. After completing the hand, the first pot is awarded to the player remaining in the hand with the highest hand. The second pot is a progressive pot and awards a distribution from the second pot based on a predetermined event. The predetermined event may be selected from the group consisting of participating for a predetermined number of hands, completing a predetermined number of rounds, reaching a predetermined time limit, or reaching a predetermined amount in the second pot.

In some embodiments, wagering games may be played without risking money in connection with the wagers (i.e., "play-for-fun" games). Access to play-for-fun wagering games may be granted on a time period basis in some embodiments. For example, upon initially joining the wagering game, each player may automatically be given wagering elements, such as, for example, chips, points, or simulated currency, that is of no redeemable value. After joining, the player may be free to place wagers using the wagering elements, and a timer may track how long the player has been participating in the wagering game. If the player exhausts his or her supply of the wagering elements before a predetermined period of time has expired, the player may simply wait until the period of time passes to rejoin the game and receive another quantity of the wagering elements to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait after exhausting their supply of wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may retain their remaining wagering elements for subsequent allotments of time and may receive additional wagering elements corresponding to the new allotment of time to further increase the balance of wagering elements at their disposal. Players may be assigned to different categories of players, which determine the number of wagering elements awarded. In a given period of time, higher-level players or players who have invested more time playing the game may earn more wagering elements per unit of time than a player assigned to a lower level group.

In some embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be purchased or may be obtained without directly exchanging money for the access tokens. For example, access tokens may be acquired by participating in member events (e.g., completing surveys, receiving training on how to play the wagering game, sharing information about the wagering game with others), spending time participating in the wagering game or in a player account forum (e.g., logged in to a social media account), or viewing advertising. Thus, an entity administering play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After a player has stopped participating in a play-for-fun wagering game, any remaining quantities of the wagering elements may be relinquished by the player, in some embodiments. For example, logging out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, the quantity of wagering elements held by a player when stopping participation may be retained and made available to the player, along with any additional quantities of wagering elements granted for new allotments of time, when rejoining the wagering game.

Figure 5:
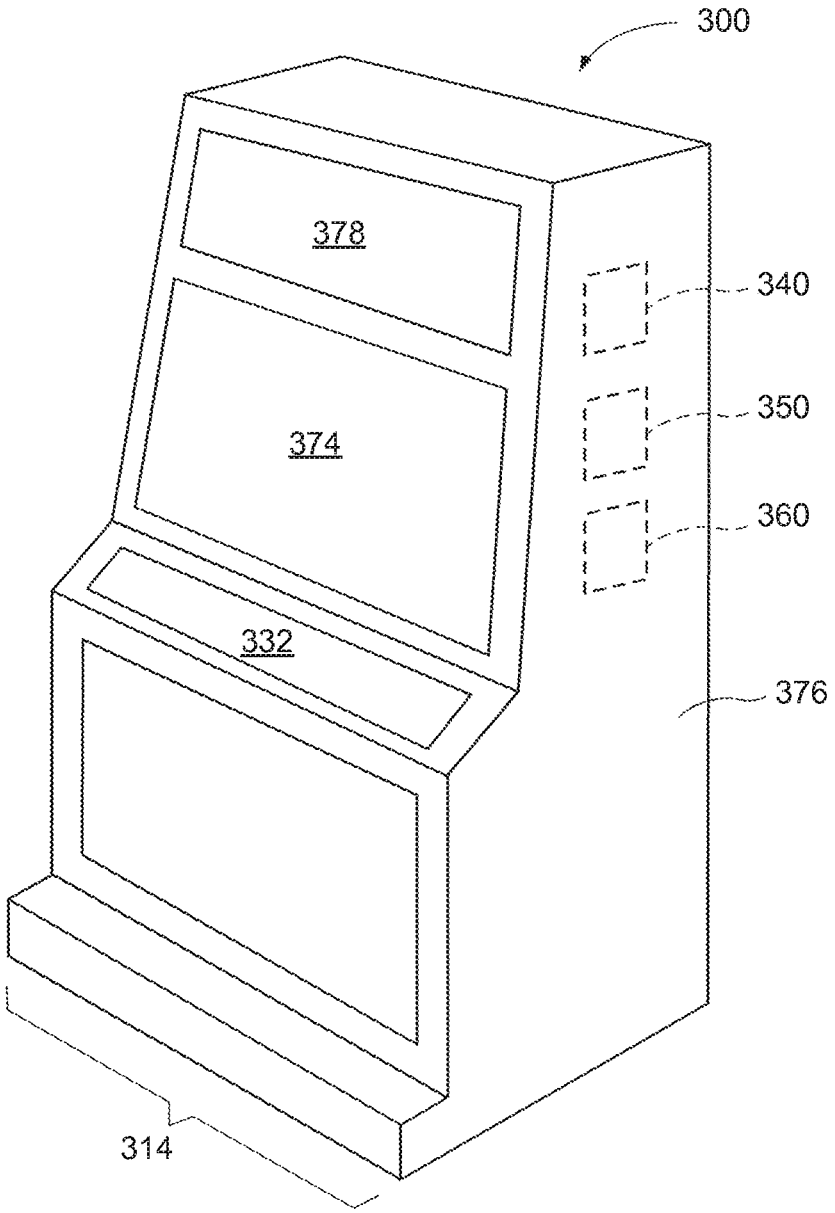
FIG. 5 is a perspective view of an individual electronic gaming device configured for implementation of embodiments of wagering games.

Referring to FIG. 5, shown is an example of an individual electronic gaming device 300 configured for implementation of embodiments of wagering games according to the present disclosure. The individual electronic gaming device 300 may include an individual player position 314 that includes a player input area 332 for a player to interact with the individual electronic gaming device 300 through various input devices (not shown). The individual electronic gaming device 300 may include a gaming screen 374 configured to display indicia for interacting with the individual electronic gaming device 300, such as through processing one or more programs stored in memory 340 to implement the rules of game play at the individual electronic gaming device 300. Accordingly, game play may be accommodated without involving physical playing cards, poker chips, and/or live personnel. The action may instead be simulated by a control processor 350 operably coupled to the memory 340 and interacting with and controlling the individual electronic gaming device 300. Although the figure has an outline of a traditional gaming cabinet, the individual electronic gaming device 300 may be implemented in any number of ways, including, but not limited to, client software downloaded to a portable device, such as a smartphone, a tablet, or a laptop personal computer. The individual electronic gaming device 300 may also be a non-portable personal computer (e.g., a desktop or an all-in-one computer) or another computing device. In some embodiments, client software is not downloaded but is native to the individual electronic gaming device 300 or is otherwise delivered with the individual electronic gaming device 300 when received by a player.

A communication device 360 may be included and operably coupled to the control processor 350 such that information related to operation of the individual electronic gaming device 300, information related to the game play, or combinations thereof may be communicated between the individual electronic gaming device 300 and other devices (not shown) through a suitable communication media, such as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners (not shown) configured to communicate rules of game play and/or the like, such as along a top portion 378 of the cabinet 376 of the individual electronic gaming device 300. The individual electronic gaming device 300 may further include additional decorative lights (not shown) and speakers (not shown) for transmitting and/or receiving sounds during game play. Further detail of an example of the individual electronic gaming device 300 (as well as other embodiments of tables and devices) is disclosed in U.S. patent application Ser. No. 13/215,156, filed Aug. 22, 2011, (published as U.S. Patent Application Publication No. 2013/0053117 A1 on Feb. 28, 2013), now abandoned, the disclosure of which is incorporated herein in its entirety by this reference.

Some embodiments may be implemented at locations that include a plurality of player stations. Such player stations may include an electronic display screen for display of game information, such as displaying virtual cards, virtual chips, and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual cards, virtual chips, etc.), some features may remain in the physical domain. As such, the game play may be administered by a live dealer, a virtual dealer, or a combination of both.

Figure 6:
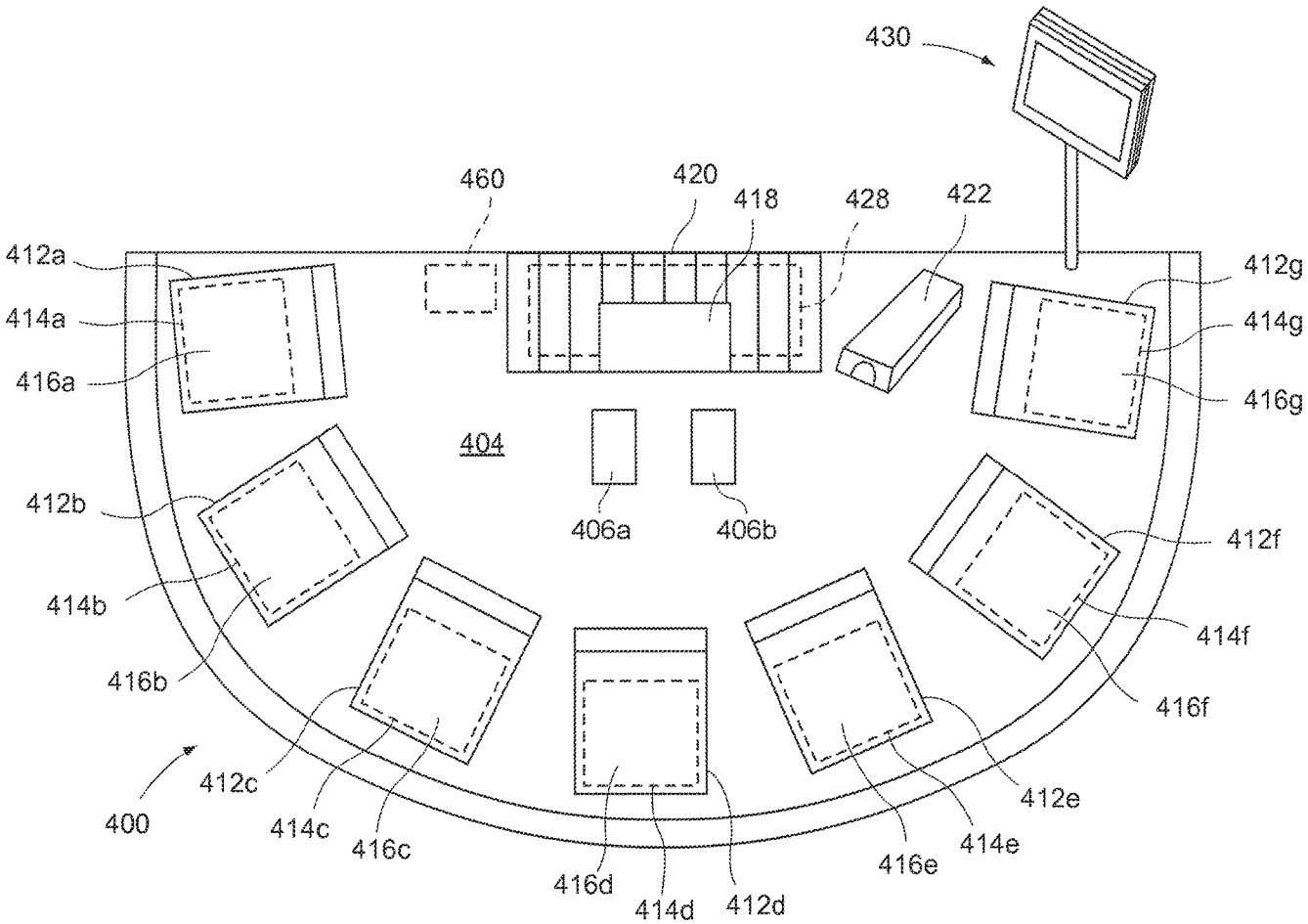
FIG. 6 is a top view of a suitable table configured for implementation of embodiments of wagering games.

Referring to FIG. 6, shown is an example of a suitable table 400 configured for implementation of embodiments of wagering games according to the present disclosure. The table 400 may include a playing surface 404. The table 400 may include a plurality of player stations 412*a* through 412*g*. Each player station 412*a* through 412*g* may include a player interface 416*a* through 416*g*, which may be used for displaying game information (e.g., game instructions, input options, wager information including virtual chips, game outcomes, etc.). The player interface 416*a* through 416*g* may include a display screen in the form of a touch screen, which may be at least substantially flush with the playing surface 404 in some embodiments. Each player interface 416*a* through 416*g* may be coupled respectively with its own local game processor 414*a* through 414*g* (shown in dashed lines), although, in some embodiments, a central game processor 428 (shown in dashed lines) may be employed and communicate directly to the player interfaces 416*a* through 416*g*. In some embodiments, a combination of the individual local game processors 414*a* through 414*g* and the central game processor 428 may be employed.

A communication device 460 may be included and operably coupled to one or more of the local game processors 414, the central game processor 428, or combinations thereof, such that information related to operation of the table 400, information related to the game play, or combinations thereof may be communicated between the table 400 and other devices (not shown) through a suitable communication media, such as, for example, wired networks, Wi-Fi networks, and cellular communication networks.

The table 400 may further include additional features, such as a dealer chip tray 420, which may be used by the dealer to cash players in and out of the wagering game, whereas wagers and balance adjustments during game play may be performed using virtual chips. For embodiments using physical cards 406*a* and 406*b*, the table 400 may further include a card handling device 422 that may be configured to shuffle, read, and deliver physical cards for the dealer and players to use during game play or, alternatively, a card shoe configured to read and deliver cards that have already been randomized. For embodiments using virtual cards, such virtual cards may be displayed at the individual player interfaces 416*a* through 416*g*. Common virtual cards may be displayed in a common card area (not shown).

The table 400 may further include a dealer interface 418, which, like the player interfaces 416*a* through 416*g*, may include touch screen controls for assisting the dealer in administering the wagering game. The table 400 may further include an upright display 430 configured to display images that depict game information, such as pay tables, hand counts, historical win/loss information by player, and a wide variety of other information considered useful to the players. The upright display 430 may be double sided to provide such information to players as well as to the casino pit.

Further detail of an example of a table and player displays is disclosed in U.S. Patent Application Pub. No. 2010/0016050, filed Jul. 15, 2008, published Jan. 21, 2010 (now U.S. Pat. No. 8,262,475, issued Sep. 11, 2012), titled "Chipless Table Split Screen Feature," the disclosure of which is incorporated herein in its entirety by this reference. Although an embodiment is described showing individual discrete player stations 412*a* through 412*g*, in some embodiments, the entire playing surface 404 may be an electronic display that is logically partitioned to permit game play from a plurality of players for receiving inputs from, and displaying game information to, the players, the dealer, or both.

Figure 7:
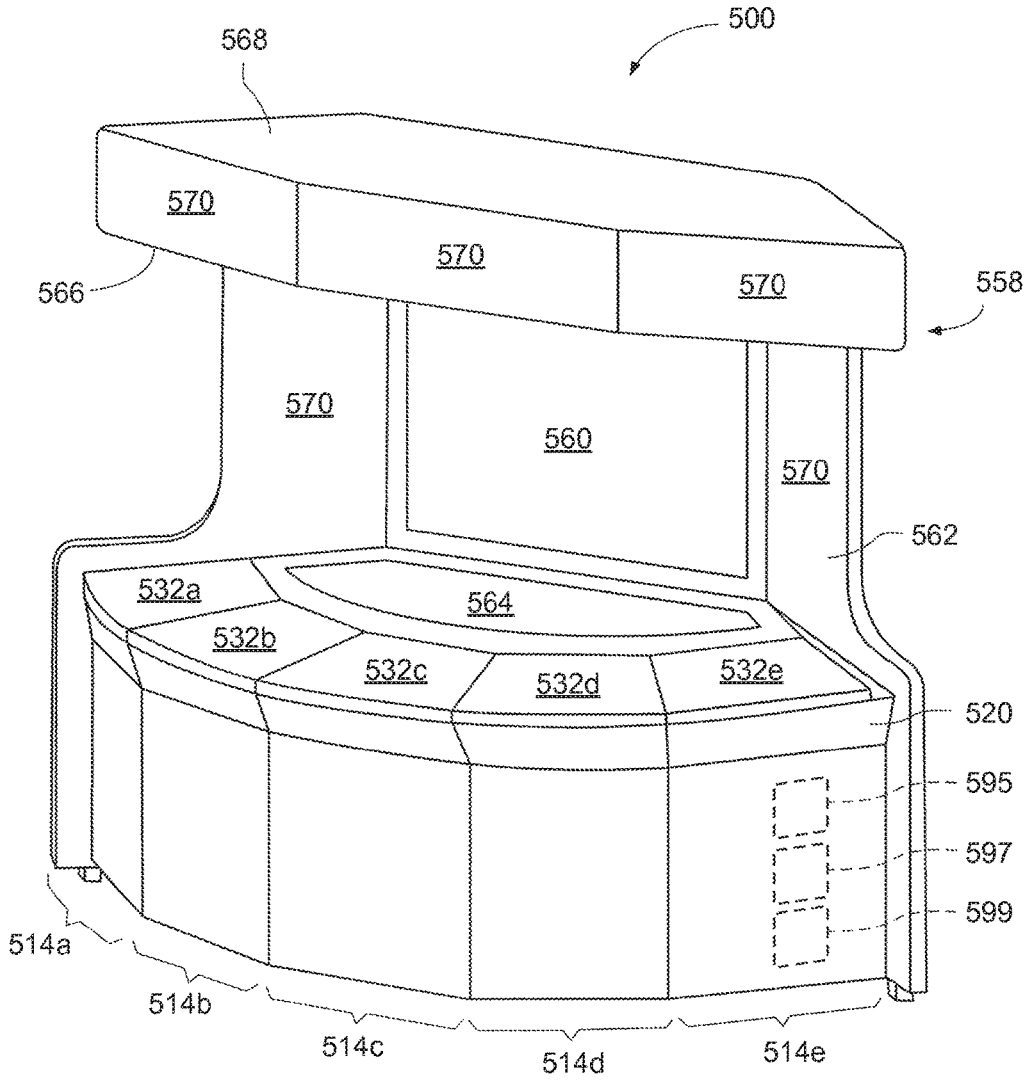
FIG. 7 is a perspective view of another embodiment of a suitable table configured for implementation of embodiments of wagering games having a virtual dealer.

Referring to FIG. 7, shown is another example of a suitable table 500 configured for implementation of embodiments of wagering games having a virtual dealer according to the present disclosure. The table 500 may include player positions 514*a* through 514*e* that are arranged in a bank about an arcuate edge 520 of a video device 558 that may comprise a card screen 564 and a dealer screen 560. The dealer screen 560 may display a video simulation of the dealer (i.e., a virtual dealer) for interacting with the video device 558, such as through processing one or more stored programs stored in memory 595 to implement the rules of game play at the video device 558. The dealer screen 560 may be carried by a generally vertically extending cabinet 562 of the video device 558. The card screen 564 may be configured to display at least one or more of the dealer's cards, the community cards, and/or the player's cards by the virtual dealer on the dealer screen 560 (virtual dealer not shown in FIG. 7).

Each of the player positions 514*a* through 514*e* may include a player interface area 532*a* through 532*e*, which is configured for wagering and game play interactions with the video device 558 and/or the virtual dealer. Accordingly, game play may be accommodated without involving physical playing cards, poker chips, and/or live personnel. The action may, instead, be simulated by a control processor 597 interacting with and controlling the video device 558. The control processor 597 may be located internally within, or otherwise proximate to, the video device 558. The control processor 597 may be programmed, by known techniques, to implement the rules of game play at the video device 558. As such, the control processor 597 may interact and communicate with display/input interfaces and data entry inputs for each player interface area 532*a* through 532*e* of the video device 558. Other embodiments of tables and gaming devices may include a control processor that may be similarly adapted to the specific configuration of its associated device.

A communication device 599 may be included and operably coupled to the control processor 597 such that information related to operation of the table 500, information related to the game play, or combinations thereof may be communicated between the table 500 and other devices (not shown) through a suitable communication media, such as, for example, wired networks, Wi-Fi networks, and cellular communication networks.

The video device 558 may further include banners (not shown) configured to communicate rules of play and/or the like, which may be located along one or more walls 570 of the cabinet 562. The video device 558 may further include additional decorative lights (not shown) and speakers (not shown), which may be located on an underside surface 566, for example, of a generally horizontally depending top 568 of the cabinet 562 of the video device 558 generally extending toward the player positions 514*a* through 514*e*.

Further detail of an example of a table and player displays is disclosed in U.S. Patent Application Publication No. 2005/0164762, filed Jan. 26, 2004, published Jul. 28, 2005, titled "Automated Multiplayer Game Table with Unique Image Feed of Dealer" (now U.S. Pat. No. 8,272,958, issued Sep. 25, 2012), the disclosure of which is incorporated herein in its entirety by this reference. Although an embodiment is described showing individual discrete player stations, in some embodiments, the entire playing surface (e.g., the player interface areas 532*a* through 532*e*, the card screen 564, etc.) may be an electronic display that is logically partitioned to permit game play from a plurality of players for receiving inputs from, and displaying game information to the players, the dealer, or both.

Figure 8:
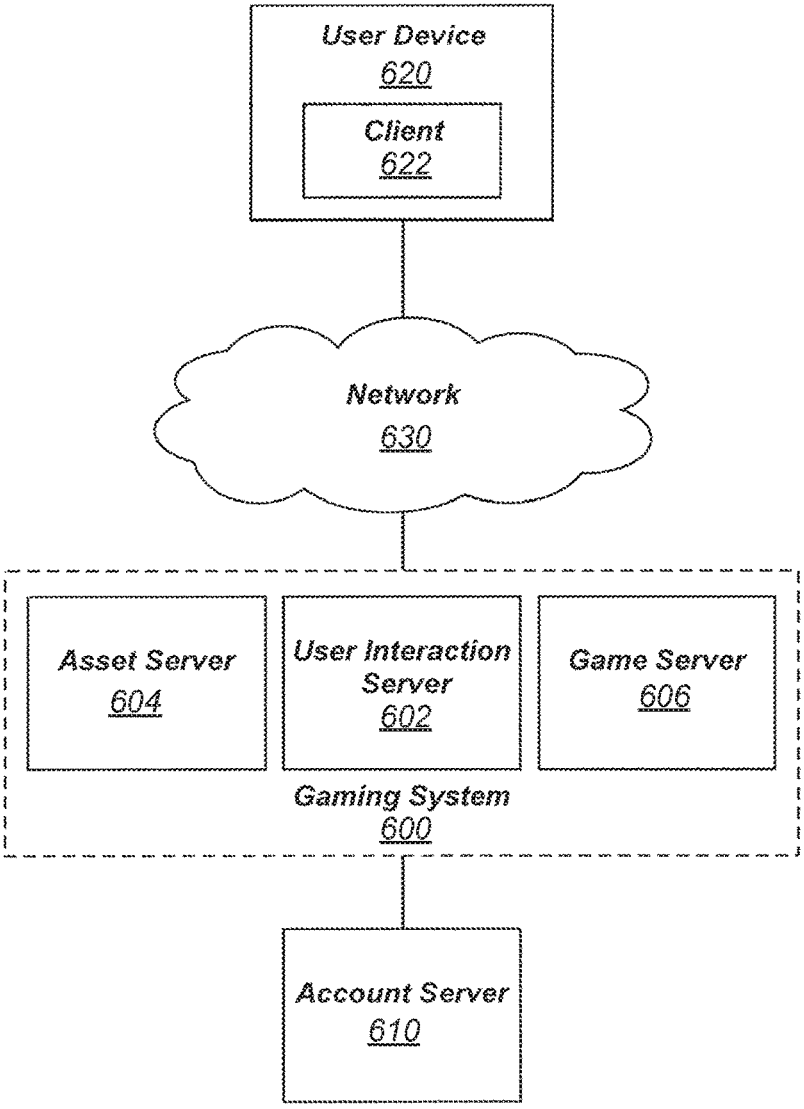
FIG. 8 is a schematic block diagram of a gaming system for implementing embodiments of wagering games.

Wagering games, in accordance with embodiments of the disclosure, may be administered over the Internet, or otherwise online, in one embodiment using a gaming system employing a client server architecture. Referring to FIG. 8, shown is a schematic block diagram of a gaming system 600 for implementing wagering games according to an embodiment. The gaming system 600 enables end users to access proprietary and/or non-proprietary game content. Such game content may include, without limitation, various types of wagering games, such as card games, dice games, big wheel games, roulette, scratch off games ("scratchers"), and any other wagering game in which the game outcome is determined, in whole or in part, by one or more random events. This includes, but is not be limited to, Class II and Class III games as defined under 25 U.S.C. § 2701 et seq. ("Indian Gaming Regulatory Act"). Such games may include banked and/or non-banked games.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, for time played in one session, or for games played; or simply being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This may attract players to the site and to the games before the players engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The system may enable players to buy additional game credits to allow the player to resume play. Objects of value may be awarded to play-for-fun players, which objects of value may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform that establishes a portal for an end user to access a wagering game hosted by a game server 606 through a user interaction server 602. A user device 620 may communicate with the user interaction server 602 of the gaming system 600 using a network 630 (e.g., the Internet). The user interaction server 602 may communicate with the game server 606 and provide game information to the user. In some embodiments, the game server 606 may also be a game engine. In some embodiments, a single user device 620 communicates with a game provided by the game server 606, while other embodiments may include a plurality of user devices 620 configured to communicate and provide end users with access to the same game provided by the game server 606. In addition, a plurality of end users may access a single user interaction server 602, or a plurality of user interaction servers 602, to access the game server 606.

The user interaction server 602 may communicate with the user device 620 to enable access to the gaming system 600. The user interaction server 602 may enable a user to create and access a user account and interact with the game server 606. The user interaction server 602 may enable users to initiate new games, join existing games, and interface with games being played by the user.

The user interaction server 602 may also provide a client 622 for execution on the user device 620 for accessing the gaming system 600. The client 622, provided by the gaming system 600 for execution on the user device 620, can comprise a variety of implementations according to the user device 620 and method of communication with the gaming system 600. In one embodiment, the user device 620 connects to the gaming system 600 using a web browser, and the client 622 executes within a browser window or frame of the web browser. In another embodiment, the client 622 is a stand-alone executable on the user device 620.

In one embodiment, the client 622 may comprise a relatively small amount of script (e.g., JAVASCRIPT®), also referred to as a "script driver," including scripting language that controls an interface of the client 622. The script driver may include simple function calls requesting information from the gaming system 600. In other words, the script driver stored in the client 622 may merely include calls to functions that are externally defined by, and executed by, the gaming system 600. As a result, the client 622 may be characterized as a "thin client." As that term is used herein, the client 622 may be little more than a script player. The client 622 may simply send requests to the gaming system 600 rather than perform logic itself. The client 622 receives player inputs, and the player inputs are passed to the gaming system 600 for processing and executing the wagering game. In one embodiment, this includes providing specific graphical display information to the client 622, as well as game outcomes.

In other embodiments, the client 622 comprises an executable file rather than a script. In that case, the client 622 may do more local processing than does a script driver, such as calculating where to show what game symbols upon receiving a game outcome from the game server 606 through the user interaction server 602. In one embodiment, it may be that portions of an asset server 604 are loaded onto the client 622 and are used by the client 622 in processing and updating graphical displays. Due to security and integrity concerns, most embodiments will have the bulk of the processing of the game play performed in the gaming system 600. However, some embodiments may include significant game processing by the client 622 when the client 622 and the user device 620 are considered trustworthy or when there is reduced concern for security and integrity in the displayed game outcome. In most embodiments, it is expected that some form of data protection, such as end-to-end encryption, will be used when data is transported over the network 630. The network 630 may be any network, including, but not limited to, the Internet.

In an embodiment in which the client 622 implements further logic and game control methodology beyond a thin client, the client 622 may parse and define player interactions prior to passing the player interactions to the gaming system 600. Likewise, when the client 622 receives a gaming interaction from the gaming system 600, the client 622 may be configured to determine how to modify the display as a result of the gaming interaction. The client 622 may also allow the player to change a perspective or otherwise interact with elements of the display that do not change aspects of the game.

In one form of the invention, the client 622 is part of an online casino that enables game play on the gaming system 600 by players playing on the user device 620. The client 622 provides a portal to the gaming system 600, and the player may not be aware that a game that is being played on the online casino is being administered by the gaming system 600. In other embodiments, the gaming system 600 is an integral part of the online casino. In other embodiments, the gaming system 600 is operated by a different entity than the entity that operates the online casino.

The gaming system 600 may include the asset server 604, which may host various media assets (e.g., audio, video, and image files) that may be sent to the client 622 for presenting the various wagering games to the end user. In other words, in this embodiment the assets presented to the end user may be stored separately from the client 622. In one embodiment, the client 622 requests the assets appropriate for the game played by the user; in other embodiments, especially those using thin clients, just those assets that are needed for a particular display event will be sent by the game server 606 when the game server 606 determines they are needed, including as few as one asset. In one example, the client 622 may call a function defined at the user interaction server 602 or the asset server 604, which may determine which assets are to be delivered to the client 622 as well as how the assets are to be presented by the client 622 to the end user. Different assets may correspond to the various clients that may have access to the game server 606 or to different games to be played.

The game server 606 is configured to perform game play methods and determine game play outcomes that are provided to the user interaction server 602 to be transmitted to the user device 620 for display on the end user's computer. For example, the game server 606 may include game rules for one or more wagering games, such that the game server 606 controls some or all of the game flow for a selected wagering game, as well as determine game outcomes. The game server 606 may include pay tables and other game logic. The game server 606 also performs random number generation for determining random game elements of the wagering game. In one embodiment, the game server 606 is separated from the user interaction server 602 by a firewall or other method of preventing unauthorized access to the game server 606 from the general members of the network 630.

The user device 620 may present a gaming interface to the player and communicate the user interaction to the gaming system 600. The user device 620 may be any electronic system capable of displaying gaming information, receiving user input, and communicating the user input to the gaming system 600. As such, the user device 620 can be a desktop computer, a laptop, a tablet computer, a set-top box, a mobile device, including, but not limited to, a smartphone, a kiosk, a terminal, or another computing device. The user device 620 may operate the client 622. When the user device 620 operates the client 622, the user device 620 may comprise the individual electronic gaming device 300 (see FIG. 5), as described above. The client 622 may be a specialized application or may be executed within a generalized application capable of interpreting instructions from the interactive gaming system 600, such as a web browser.

The client 622 may interface with an end user through a web page or an application that runs on a device, including, but not limited to, a smartphone, a tablet, or a general computer, or be any other computer program configurable to access the gaming system 600. The client 622 may be illustrated within a casino webpage (or other interface) indicating that the client 622 is embedded into a webpage, which is supported by a web browser executing on the user device 620.

In one embodiment, the gaming system 600 may be operated by different entities. The user device 620 and/or device housing the client 622 may be operated by a third party, such as a casino or an individual, that links to the gaming system 600, which may be operated, for example, by a wagering game service provider. Therefore, in some embodiments, the user device 620 and the client 622 may be operated by a different administrator than the operator of the game server 606. In other words, the user device 620 may be part of a third-party system that does not administer or otherwise control the gaming system 600 or the game server 606. In another embodiment, the user interaction server 602 and the asset server 604 are provided by a third-party system. For example, a gaming entity (e.g., a casino) may operate the user interaction server 602 or the user device 620 to provide its customers access to game content managed by a different entity, which may control the game server 606, amongst other functionality. In some embodiments, these functions are operated by the same administrator. For example, a gaming entity (e.g., a casino) may elect to perform each of these functions in-house, such as providing both the access to the user device 620 and the actual game content and providing administration of the gaming system 600.

The gaming system 600 may communicate with one or more external account servers 610, optionally through another firewall. For example, the gaming system 600 itself may not directly accept wagers or issue payouts. That is, the gaming system 600 may facilitate online casino gaming, but may not be part of a self-contained online casino itself. Instead, the gaming system 600 may facilitate the play of wagering games owned and controlled by a company offering games and gaming products and services, such as SHFL entertainment, Inc. Another entity (e.g., a casino or any account holder or financial system of record) may operate and maintain its external account servers 610 to accept bets and make payout distributions. The gaming system 600 may communicate with the account servers 610 to verify the existence of funds for wagering and instruct the account server 610 to execute debits and credits.

In some embodiments, the gaming system 600 may directly accept bets and make payout distributions, such as in the case where an administrator of the gaming system 600 operates as a casino. As discussed above, the gaming system 600 may be integrated within the operations of a casino rather than separating out functionality (e.g., game content, game play, credits, debits, etc.) among different entities. In addition, for play-for-fun wagering games, the gaming system 600 may issue credits, take bets, and manage the balance of the credits according to the game outcomes, but the gaming system 600 may not permit payout distributions or be linked to the account server 610 that permits payout distributions. Such credits may be issued for free, through purchase, or for other reasons, without the ability for the player to cash out. Such play-for-fun wagering games may be played on platforms that do not permit traditional gambling, such as to comply with jurisdictions that do not permit online gambling.

The gaming system 600 may be configured in many ways, from a fully integrated single system to a distributed server architecture. The asset server 604, the user interaction server 602, the game server 606, and the account server 610 may be configured as a single, integrated system of code modules running on a single server or machine, wherein each of the servers is functionally implemented on a single machine. In such a case, the functionality described herein may not be implemented as separate code modules. The asset server 604, the user interaction server 602, the game server 606, and the account server 610 may also be implemented as a plurality of independent servers, each using its own code modules running on a separate physical machine, and may further include one or more firewalls between selected servers (depending on security needs). Each server could communicate over some kind of networked connection, potentially as varied as that described for the network 630. Further, each single server shown in FIG. 8 may be implemented as a plurality of servers with load balancing and scalability factors built into the embodiment. All such embodiments and variations are fully contemplated.

Additional features may be supported by the game server 606, such as hacking and cheating detection, data storage and archival, metrics generation, messages generation, output formatting for different end user devices, as well as other features and operations. For example, the gaming system 600 may include additional features and configurations as described in U.S. patent application Ser. No. 13/353,194, filed Jan. 18, 2012, (published as U.S. Patent Application Publication No. 2013/0184079 A1 on Jul. 18, 2013) and U.S. patent application Ser. No. 13/609,031, filed Sep. 10, 2012 (published as U.S. Patent Application Publication No. 2013/0184059 A1 on Jul. 18, 2013), both titled "Network Gaming Architecture, Gaming Systems, and Related Methods," the disclosures of which are incorporated herein in their entirety by this reference.

The network 630 may enable communications between the user device 620 and the gaming system 600. A network (not shown) may also connect the gaming system 600 and the account server 610, and, further, one or more networks (not shown) may interconnect one or more of the other servers shown collectively as the gaming system 600. In one embodiment, the network 630 uses standard communications technologies and/or protocols. Thus, the network 630 can include links using technologies such as Ethernet, 802.11, worldwide interoperability for microwave access (WiMAX), 3G, digital subscriber line (DSL), asynchronous transfer mode (ATM), INFINIBAND®, PCI Express Advanced Switching, etc. Similarly, the networking protocols used on the network 630 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 630 can be represented using technologies and/or formats including the hypertext markup language (HTML), the extensible markup language (XML), etc. In addition, all or some of the links can be encrypted using conventional encryption technologies, such as secure sockets layer (SSL), transport layer security (TLS), virtual private networks (VPNs), Internet Protocol security (IPsec), etc. In another embodiment, the entities can use custom and/or dedicated data communications technologies instead of, or in addition to, the ones described above. Depending upon the embodiment, the network 630 can include links comprising one or more networks, such as the Internet.

Figure 9:
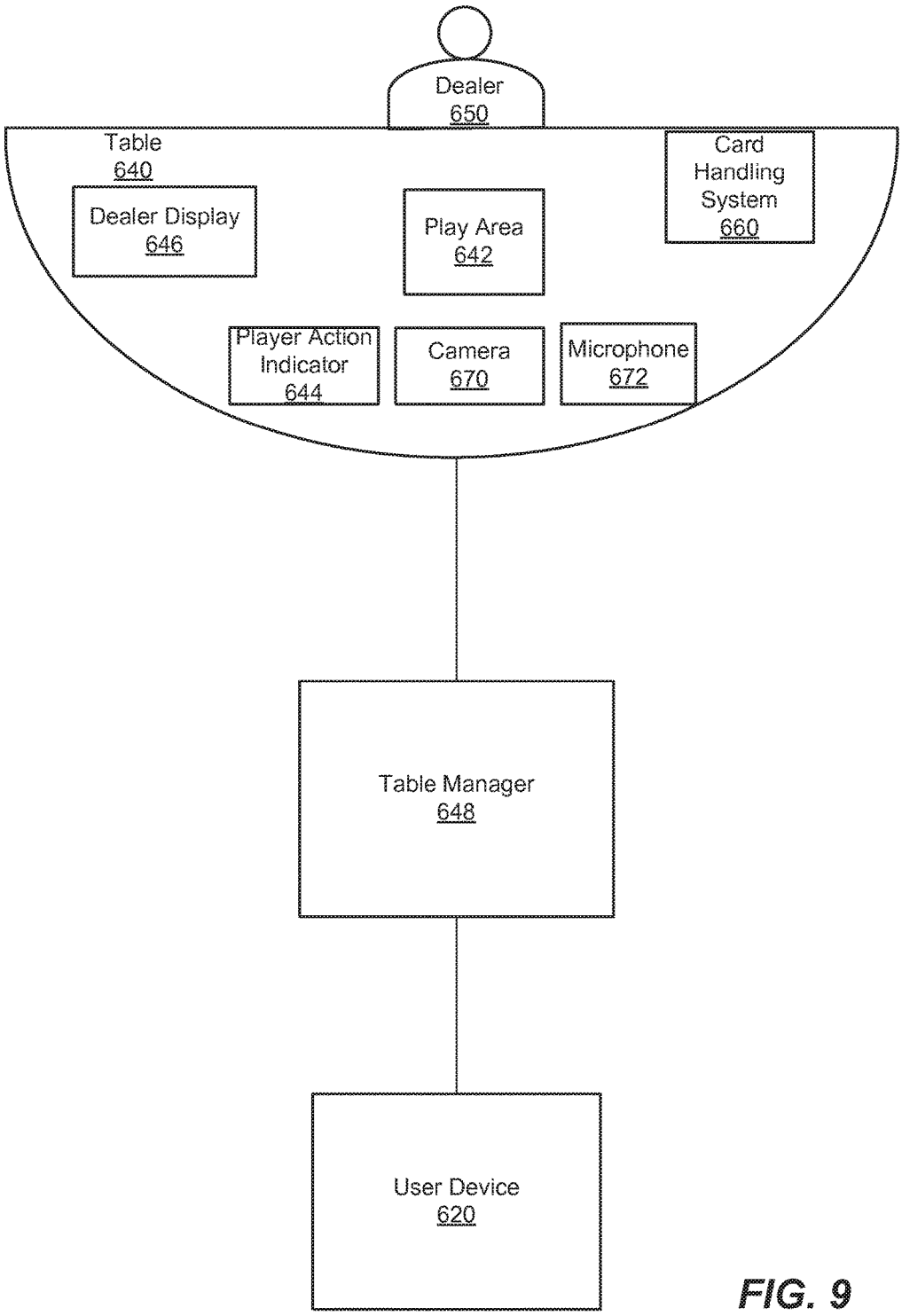
FIG. 9 is a schematic block diagram of a gaming system for implementing embodiments of wagering games including a live dealer feed.

FIG. 9 is a schematic block diagram of a gaming system for implementing embodiments of wagering games including a live dealer feed. Features of the gaming system 600 (FIG. 8) as described above are generally implemented by this embodiment, except as further described. In this embodiment, rather than cards being determined by a computerized random process, cards are dealt by a dealer 650 at a table 640 from a card handling system 660. A table manager 648 assists the dealer 650 in facilitating play of the game by transmitting a video feed of the actions of the dealer 650 to the user device 620 and transmitting player elections to the dealer 650. As described above, the table manager 648 communicates with the gaming system 600 (FIG. 8) to provide gaming at the table 640 to users of the gaming system 600. Thus, the table manager 648 communicates with the user device 620 through a network and may be a part of a larger online casino or may be operated as a separate system that facilitates game play. In various embodiments, each table 640 is managed by an individual table manager 648 constituting a gaming device, which receives and processes information relating to that table 640. For simplicity of description, these functions are described as being performed by the table manager 648, though certain functions may be performed by an intermediary gaming system 600 (FIG. 8). In some embodiments, the gaming system 600 may match players to the tables 640 and facilitate transfer of information between user devices 620 and gaming devices, such as wagering amounts and player action elections, but does not manage gameplay at individual tables 640. In other embodiments, functions of the table manager 648 are incorporated into the gaming system 600 (FIG. 8).

The table 640 includes a camera 670 and optionally a microphone 672 that capture video and audio feeds relating to the table 640. The camera 670 is trained on the dealer 650, a play area 642, and the card handling system 660. As the game is administered by the dealer 650, the player using the user device 620 is shown the video feed captured by the camera 670 and any audio captured by the microphone 672.

The card handling system 660 is typically a shuffling device, though the card handling system 660 may also be a shoe for dispensing cards. When the game play rules require cards to be dealt, the dealer 650 obtains a card from the card handling system 660 and places the card in the appropriate location in the play area 642. The play area 642 depicts player positions and any applicable card locations for playing the same, such as shown in FIGS. 2 and 3. As determined by the rules of the game, the player at the user device 620 is presented options for responding to an event in the game using the client 622, as described with reference to FIG. 8.

The user device 620 presents the options to the player and permits the player to select an election from among the options. The election is transmitted to the table manager 648, which provides player elections to the dealer 650 using a dealer display 646 and a player action indicator 644 on the table 640. The dealer display 646 and the player action indicator 644 provide information to the dealer 650 regarding the game play and elections made by players. Using the dealer display 646, for example, the dealer 650 may obtain information regarding where to deal the next card or which player position is responsible for the next action.

In one embodiment, the table manager 648 receives card information from the card handling system 660 describing cards dealt by the card handling system 660. The card handling system 660 may include a card reader that determines card information from the card. For example, the card handling system 660 may process an image of the card, or the card handling system 660 may include a barcode reader or other system for obtaining information regarding each card. The card information may include rank and suit of each dealt card, which is obtained by the card handling system 660 and transmitted to the table manager 648. The card handling system 660 may also dispense more than one card at once or identify a set of cards dispensed together as a hand. One example card handling system 660 is described in U.S. Pat. No. 8,070,574, which is hereby incorporated by reference.

Using the card information, the table manager 648 identifies hands associated with each player and, when applicable, the dealer. The table manager 648 uses the card information and identified hands, along with the elected player decisions, to determine gameplay events and, using the rules of the game, determine wager results. Alternatively, the wager results are determined by the dealer 650 and input to the table manager 648, and the wager results may be used to confirm automatically determined results by the gaming system 600 (FIG. 8). Optionally, the card information relating to cards viewable by a player is also transmitted to the user device 620 associated with the player, permitting representations of the cards to be displayed to the user in addition to the cards viewed in the play area 642.

The live video feed permits the dealer 650 to show cards dealt by the card handling system 660 and play the game as though the player were at a live casino. In addition, the dealer 650 can prompt a user by announcing a player's election is to be performed. In embodiments in which the microphone 672 is included, the dealer 650 can verbally announce action or request an election by a player. In some embodiments, the user device 620 also includes a camera or microphone, which also captures feeds to be shared with the dealer 650 and other players.

Figure 10:
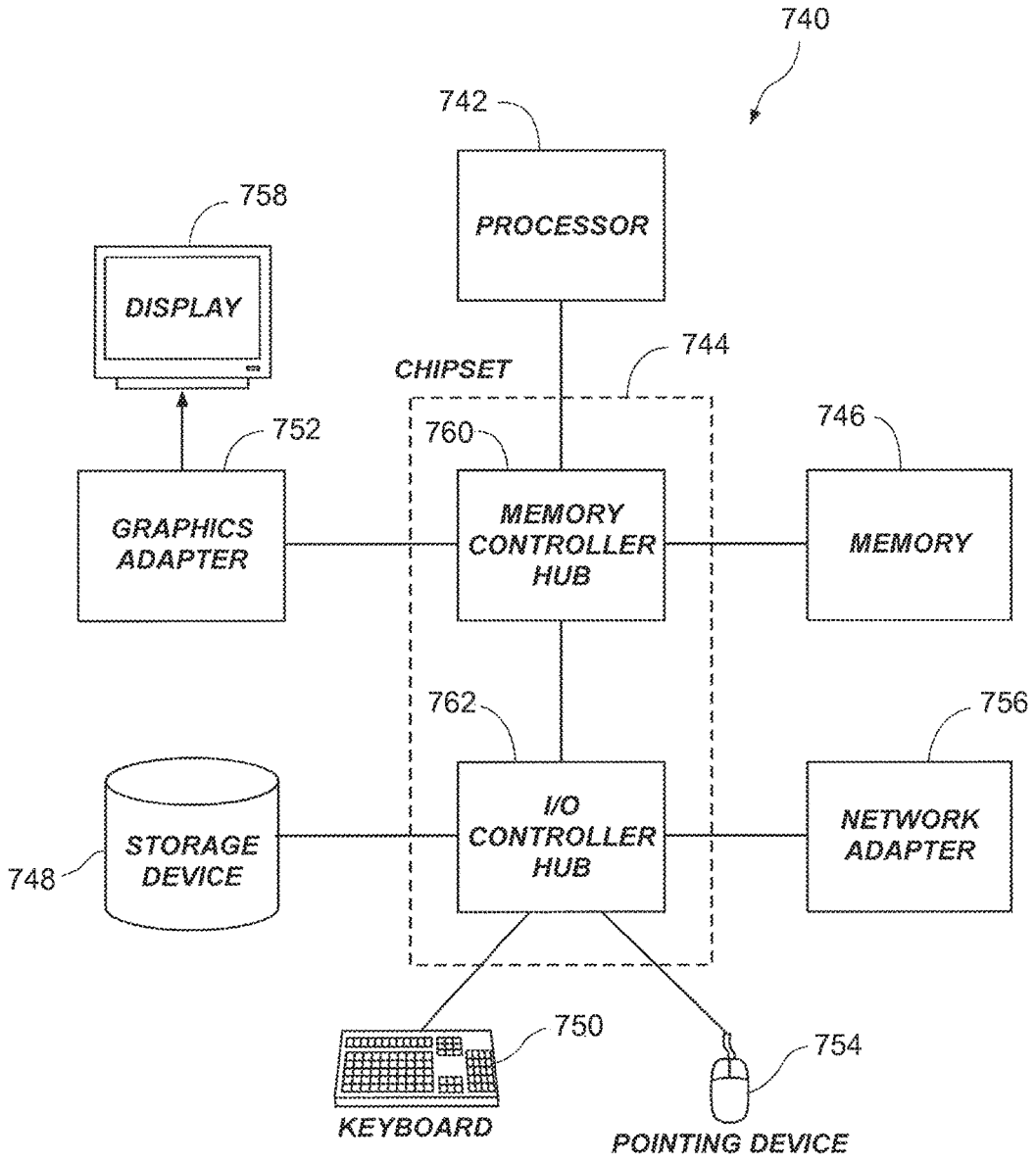
FIG. 10 is a block diagram of a computer for acting as a gaming system according to one embodiment.

Referring to FIG. 10, shown is a high-level block diagram of a computer system 740 for acting as the gaming system 600 (see FIGS. 8 and 9), according to one embodiment. Illustrated are at least one processor 742 coupled to a chipset 744, as indicated in dashed lines. Also coupled to the chipset 744 are a memory 746, a storage device 748, a keyboard 750, a graphics adapter 752, a pointing device 754, and a network adapter 756. A display 758 is coupled to the graphics adapter 752. In one embodiment, the functionality of the chipset 744 is provided by a memory controller hub 760 and an I/O controller hub 762. In another embodiment, the memory 746 is coupled directly to the processor 742 instead of to the chipset 744.

The storage device 748 is any non-transitory computer-readable storage medium, such as a hard drive, a compact disc read-only memory (CD-ROM), a DVD, or a solid-state memory device (e.g., a flash drive). The memory 746 holds instructions and data used by the processor 742. The pointing device 754 may be a mouse, a track pad, a track ball, or another type of pointing device and is used in combination with the keyboard 750 to input data into the computer system 740. The graphics adapter 752 displays images and other information on the display 758. The network adapter 756 couples the computer system 740 to a local or wide area network.

As is known in the art, the computer system 740 can have different and/or other components than those shown in FIG. 10. In addition, the computer system 740 can lack certain illustrated components. In one embodiment, the computer system 740 acting as the gaming system 600 (FIG. 8) lacks the keyboard 750, the pointing device 754, the graphics adapter 752, and/or the display 758. Moreover, the storage device 748 can be local and/or remote from the computer system 740 (such as embodied within a storage area network (SAN)). Moreover, other input devices, such as, for example, touch screens may be included.

The network adapter 756 (may also be referred to herein as a "communication device") may include one or more devices for communicating using one or more of the communication media and protocols discussed above with respect to FIG. 8.

In addition, some or all of the components of this general computer system 740 of FIG. 10 may be used as part of the processor and memory discussed above with respect to the systems of FIGS. 5, 6, and 7.

The gaming system 600 (FIG. 8) may comprise several such computer systems 740. The gaming system 600 may include load balancers, firewalls, and various other components for assisting the gaming system 600 to provide services to a variety of user devices 620 (FIGS. 8 and 9).

As is known in the art, the computer system 740 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 748, loaded into the memory 746, and executed by the processor 742.

Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," or the like, refer to the action and processes of a computer system, or similar electronic computing device (such as a specific computing machine), that manipulates and transforms data represented as physical (electronic) quantities within the computer system memories or registers or other such information storage, transmission, or display devices.

Certain aspects of the embodiments include process steps and instructions described herein in the form of an algorithm. It should be noted that the process steps and instructions of the embodiments can be embodied in software, firmware, or hardware, and, when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventor.

What is claimed is:

1. A method of operating a gaming system over a network, comprising:

providing a server of a gaming system;

providing, by the server, a client for execution on a user device connected to the network and associated with a player, the user device being remote from the server; and operating the gaming system in a round of the method according to a set of rules applied in an ordered combination of steps, the set of rules comprising rules of:

the player must wager to participate in the round;

play of the round is head-to-head poker with a player hand of cards competing against a dealer hand of cards, the player hand of cards associated with the player, the dealer hand of cards associated with a dealer;

the player is provided more cards than are needed to form the player hand;

the dealer is provided more cards than are needed to form the dealer hand; and an amount of an in-round wager is variable, not being preset before administration of the round; and the ordered combination of steps comprising:

applying the rule that the player must wager to participate in the round, comprising the client receiving, from the user device and communicating to the server:

at least one credit for an Ante, in a form of at least one virtual gaming chip in a designated ante wager area on a virtual play surface of a virtual play table, to enter the player to participate in a wagering game, and at least one other credit, in a form of at least another virtual gaming chip in a designated bonus wager area on the virtual play surface of the virtual play table, to enter the player to participate in a Bonus event;

applying the rule that the player is provided more cards than are needed to form the player hand and applying the rule that the dealer is provided more cards than are needed to form the dealer hand, comprising:

the server determining a set of five player cards and a set of six dealer cards, each of the set of five player cards and the set of six dealer cards randomly selected by the server from a set of playing cards;

the server communicating to the user device the set of five player cards for display on the user device in a player card receiving area on the virtual play surface of the virtual play table;

the server receiving, from the client, an indication of a four-card player hand formed from the five player cards, the four-card player hand providing the player hand of cards associated with the player; and the server determining a four-card dealer hand from the set of six dealer cards, the four-card dealer hand providing the dealer hand of cards associated with the dealer;

applying the rule that the amount of the in-round wager is variable, comprising the server receiving, from the client, a game play election selected, by the player at the user device, from:

a fold election and a Play event election of:

1× the Ante, as the in-round wager, for the four-card player hand exceeded by a predetermined threshold ranking, and 1× to 3× the Ante, as the in-round wager, for the four-card player hand at least equaling the predetermined threshold ranking; and applying the rule that play of the round is head-to-head poker with the player hand of cards competing against the dealer hand of cards, comprising, after the server receives the game play election, the server resolving any of the Ante, the Bonus event, and the Play event not already resolved comprising:

for the Ante and the Play event, the server comparing the four-card player hand to the four-card dealer hand; and for the Bonus event, the server applying a bonus threshold and a bonus pay table to the four-card player hand.

2. The method of claim 1, wherein the at least one credit for the Ante and the at least one other credit to enter the player to participate in the Bonus event are virtual credits.

3. The method of claim 2, wherein the virtual credits are play-for-fun credits of no monetary value.

4. The method of claim 2, wherein the ordered combination of steps further comprises distributing additional virtual credits to the player associated with the user device based on a hierarchy of players.

5. A method of operating a gaming system over a network and in communication with a remote user device, the method comprising:

providing, by a server of the gaming system, a client for execution on the remote user device connected to the network and associated with a player; and after providing the client, operating the gaming system in a round of the method according to a set of rules applied in an ordered combination of acts, the set of rules comprising rules of:

the player must wager to participate in the round;

play of the round is head-to-head poker with a player hand of cards competing against a dealer hand of cards, the player hand of cards associated with the player, the dealer hand of cards associated with a dealer;

the player is provided more cards than are needed to form the player hand;

the dealer is provided more cards than are needed to form the dealer hand; and an amount of an in-round wager is variable, not being preset before administration of the round; and the ordered combination comprising:

applying the rule that the player must wager to participate in the round, comprising the client receiving, from the remote user device and communicating to the server:

an Ante to enter the player in the round of the method, and a Bonus event entry;

applying the rule that the player is provided more cards than are needed to form the player hand, comprising:

the server determining a set of five player cards randomly selected by the server from a set of playing cards;

the server communicating to the user device the set of five player cards for display on the remote user device in a player card receiving area on a virtual play surface of a virtual play table;

the server receiving, from the remote user device, an instruction to form a four-card player hand from the set of five player cards, the four-card player hand providing the player hand of cards associated with the player; and the server communicating to the remote user device the four-card player hand for display on the remote user device;

applying the rule that the amount of the in-round wager is variable, comprising the server receiving, from the client, a game play election option selected, by the player at the user device, from:

a fold election and a Play event entry of

1× the Ante, as the in-round wager, with the four-card player hand exceeded by a threshold ranking, and 1×, 2×, and 3× the Ante, as the in-round wager, with the four-card player hand at least equaling the threshold ranking;

applying the rule that play of the round is head-to-head poker with the player hand of cards competing against the dealer hand of cards and applying the rule that the dealer is provided more cards than are needed to form the dealer hand, comprising the server resolving at least the Ante and the Play event, comprising distributing at least a portion of a game pot to the player upon a rank of the four-card player hand exceeding a rank of a four-card dealer hand formed from a set of six dealer cards from the set of playing cards; and the server resolving the Bonus event entry, comprising applying a bonus threshold and a bonus pay table to the rank of the four-card player hand, wherein the game pot comprises all of the Ante, the Bonus event entry, and the Play event entry received by the server or the client, and wherein the Ante, the Bonus event entry, and the Play event entry are each indicated by at least one virtual, monetarily valuable gaming chip in a respective designated area on the virtual play surface of the virtual play table.

6. The method of claim 5, further comprising, before the server determining the set of five player cards:

the client receiving from the remote user device and communicating to the server an indication of a poker pot entry; and the gaming system adding the poker pot entry to a poker pot having no house advantage.

7. The method of claim 5, further comprising, before the server determining the set of five player cards:

the client receiving, from the remote user device and communicating to the server, an additional bonus event entry;

the gaming system adding the additional bonus event entry to the game pot before the server resolving at least the Ante and the Play event; and after the server distributing at least the portion of the game pot to the player upon the rank of the four-card player hand exceeding the rank of the four-card dealer hand, the server distributing at least another portion of the game pot for occurrence of a predetermined event.

8. The method of claim 7, further comprising, before the server distributing at least the portion of the game pot and at least the other portion of the game pot, the gaming system deducting a rake from the game pot.

9. The method of claim 7, wherein the predetermined event is a predetermined number of hands, a predetermined number of rounds, a predetermined time limit, or a predetermined total in the game pot.

10. The method of claim 7, wherein the predetermined event is the rank of the four-card player hand at least equaling a qualifying hand rank.

11. The method of claim 7, wherein the game pot is a progressive pot.

12. A system for executing a set of instructions over a network and in communication with at least one remote user device, the system comprising:

a storage device comprising a non-transitory computer-readable storage medium storing a set of instructions; and at least one processor in communication with the storage device and at least one user device remote from the storage device, the at least one processor configured to execute the set of instructions, the set of instructions defined to, when executed by the at least one processor, cause the system to perform an ordered combination of acts by which a set of rules are applied:

the set of rules comprising:

a player must wager to participate in a wagering game;

play of the wagering game is head-to-head poker with a player hand of cards competing against a dealer hand of cards, the player hand of cards associated with the player, the dealer hand of cards associated with a dealer;

the player is provided more cards than are needed to form the player hand;

the dealer is provided more cards than are needed to form the dealer hand; and an amount of an in-round wager is variable, not being preset before administration of the wagering game; and performance of the ordered combination of acts causing the system to, for each of the at least one user device:

in applying the rule that the player must wager to participate in the wagering game, receive, from the user device, an indication of an Ante and an indication of a Bonus event entry to enter the player associated with the user device to participate in the wagering game, the indication of the Ante and the indication of the Bonus event entry comprising at least one virtual gaming chip in a respective designated wager area on a virtual play surface of a virtual play table;

in applying the rule that the player is provided more cards than are needed to form the player hand and in applying the rule that the dealer is provided more cards than are needed to form the dealer hand:

determine, by random selection, a set of five player cards a set of playing cards;

communicate, to the user device, the set of five player cards for display on the user device in a player card receiving area on the virtual play surface of the virtual play table;

determine, by random selection, a set of six dealer cards from the set of playing cards;

receive, from the user device, an indication of a four-card player hand formed from the set of five player cards, the four-card player hand providing the player hand of cards associated with the player; and determine a four-card dealer hand from the set of six dealer cards, the four-card dealer hand providing the dealer hand of cards associated with the dealer;

in applying the rule that the amount of the in-round wager is variable, receive, from the user device, a game play election selected, at the user device, from an election set consisting of:

a fold election and an indication of a Play event entry, comprising at least one virtual gaming chip in a respective designated wager area on the virtual play surface of the virtual play table, of:

1× the Ante, as the in-round wager, for a rank of the four-card player hand exceeded by a threshold rank; and 1× to 3× the Ante, as the in-round wager, for the rank of the four-card player hand at least equaling the threshold rank;

in applying the rule that play of the wagering game is head-to-head poker with the player hand of cards competing against the dealer hand of cards, resolve the indication of the Ante and the indication of the Play event entry, comprising comparing the rank of the four-card player hand to a rank of the four-card dealer hand; and resolve the Bonus event entry, comprising comparing the rank of the four-card player hand to a bonus threshold rank defined in a bonus pay table.

13. The system of claim 12, wherein the indication of the Ante, the indication of the Bonus event entry, and the indication of the Play event entry are in a form of virtual credits.

14. The system of claim 13, wherein the virtual credits have no monetary value.

15. The system of claim 12, wherein the set of instructions is defined to, when executed by the at least one processor, further cause the system to, when performing the ordered combination of acts, add all received of the indication of the Ante, the indication of the Bonus event entry, and the indication of the Play event entry to a game pot.

16. The system of claim 15, wherein the set of instructions is defined to, when executed by the at least one processor, further cause the system to, when resolving all received of the indication of the Ante and the indication of the Play event entry, distribute at least a portion of the game pot to the user device for the rank of the four-card player hand exceeding the rank of the four-card dealer hand.

17. The system of claim 16, wherein the set of instructions is defined to, when executed by the at least one processor, further cause the system to, when performing the ordered combination of acts, receive, from the user device, an entry to a poker pot, the poker pot having no house advantage and including other poker pot entries received from other remote user devices of the at least one remote user device.

18. The system of claim 16, wherein the set of instructions is defined to, when executed by the at least one processor, further cause the system to, when resolving all received of the indication of the Ante and the indication of the Play event entry:

distribute only a portion of the game pot to the user device for the rank of the four-card player hand exceeding the rank of the four-card dealer hand; and retain a remaining portion of the game pot to carry over for another execution of the set of instructions.

19. The system of claim 15, wherein the set of instructions is defined to, when executed by the at least one processor, further cause the system to, when performing the ordered combination of acts, deduct a rake from the game pot.

* * * * *